US006778163B2

(12) United States Patent
Ozawa

(10) Patent No.: US 6,778,163 B2
(45) Date of Patent: Aug. 17, 2004

(54) LIQUID CRYSTAL DISPLAY DEVICE, DRIVING CIRCUIT, DRIVING METHOD, AND ELECTRONIC APPARATUS

(75) Inventor: Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 10/022,616

(22) Filed: Dec. 20, 2001

(65) Prior Publication Data

US 2002/0084970 A1 Jul. 4, 2002

(30) Foreign Application Priority Data

Dec. 28, 2000 (JP) ..... 2000-403228

(51) Int. Cl.[7] ..... G09G 3/36
(52) U.S. Cl. ..... 345/96; 345/90
(58) Field of Search ..... 345/87, 89, 690, 345/100, 209, 98, 96, 90

(56) References Cited

U.S. PATENT DOCUMENTS 4,734,692 A * 3/1988 Hosono et al. ..... 345/96
5,119,085 A * 6/1992 Yamazaki ..... 345/96
5,144,292 A * 9/1992 Shiraishi et al. ..... 345/102
5,307,084 A * 4/1994 Yamaguchi et al. ..... 345/58
5,414,443 A * 5/1995 Kanatani et al. ..... 345/95
5,646,644 A * 7/1997 Furuhashi et al. ..... 345/100
5,793,344 A * 8/1998 Koyama ..... 345/87
5,874,933 A * 2/1999 Hirai et al. ..... 345/89
6,104,364 A * 8/2000 Hayashi ..... 345/87
6,157,358 A * 12/2000 Nakajima et al. ..... 345/96

FOREIGN PATENT DOCUMENTS

JP 06-265846 9/1994
JP 06-324305 11/1994

* cited by examiner

*Primary Examiner*—Vijay Shankar
*Assistant Examiner*—Nitin Patel
(74) *Attorney, Agent, or Firm*—Oliff & Berridge, PLC

(57) ABSTRACT

The present invention provides a liquid crystal display in which a voltage amplitude of a data signal which is supplied to a data line, is kept small, thereby reducing the power consumption. When a scanning signal supplied to a scanning line is set to an H level, a data signal with the voltage depending on the gray level and depending on the writing polarity is applied to a data line. In this case, a thin-film transistor (TFT) is turned on, thus a liquid crystal capacitor and storage capacitor store the charge corresponding to the data signal. Then, the scanning signal is set to an L level to turn TFT off, and the voltage of the other terminal of the storage capacitor is raised from the low side of capacitor voltage $V_{st}(-)$ to the high side $V_{st}((+))$, and the charge corresponding to the raised voltage amount is redistributed to the liquid crystal capacitor. By this means, the effective voltage value applied to the liquid crystal capacitor can correspond to the voltage amplitude of the data signal or more. Accordingly, the present invention can reduce the voltage amplitude of the voltage signal applied to the data line in comparison with the voltage amplitude applied to a pixel electrode, therefore allowing power consumption to be reduced.

13 Claims, 20 Drawing Sheets

(a)

Csetl

| | | Cset | |
|---|---|---|---|
| | | L | H |
| PS | L | L | H |
| | H | H | L |

(b)

$\overline{\text{Csetl}}$

| | | Cset | |
|---|---|---|---|
| | | L | H |
| PS | L | H | L |
| | H | L | H |

FIG. 3

Vdac1

| | | Cset | |
|---|---|---|---|
| | | L | H |
| PS | L | Vsk(-) | Vcw(-) |
| | H | Vsw(+) | Vck(+) |

FIG. 4

Vdac2

| | | Cset | |
|---|---|---|---|
| | | L | H |
| PS | L | Vsw(-) | Vck(-) |
| | H | Vsk(+) | Vcw(+) |

FIG. 5

LIQUID CRYSTAL DISPLAY DEVICE, DRIVING CIRCUIT, DRIVING METHOD, AND ELECTRONIC APPARATUS

BACKGROUND OF THE INVENTION

1. Field of Invention

The present invention relates to a liquid crystal display device designed to have lower swing voltage to a data line in order to reduce power consumption. Additionally, the present invention relates to a driving circuit, to a driving method, and to electronic devices having the liquid crystal display device.

2. Description of Related Art

In recent years, liquid crystal display devices (LCD) have been used widely for various information processing devices, flat-screen TVs, and the like as display devices to replace cathode ray tubes (CRT).

These liquid crystal display devices can be classified into various types depending on the driving method and so on. An active-matrix-type LCD device, in which pixels are driven by switching elements, can be arranged as follows. Specifically, an active-matrix-type LCD device can include pixel electrodes arranged in a matrix, an element substrate provided with switching elements connected to each of the pixel electrodes, a counter substrate on which counter electrodes are formed to face the pixel electrodes, and liquid crystal sandwiched between both of these substrates.

In this arrangement, when an on-voltage is applied to a scanning line, the switching element connected to the scanning line becomes conductive. In the conductive state, if the voltage signal corresponding to a gray scale (density) is applied to an element electrode via a data line, the charge corresponding to the voltage signal is stored in a liquid crystal capacitor in which the liquid crystal is sandwiched between the element electrode and counter electrode. After the charge is stored, even if an off-voltage is applied to the scanning line to make the switching element nonconductive, the charge stored in the liquid crystal is maintained by the capacitance of the liquid crystal capacitor itself, in addition to the accompanying storage capacitor.

In this manner, by driving each switching element and controlling the amount of charge to be stored according to the gray scale, the orientation of the liquid crystal changes. Thus, the gray level is changed for every pixel, thereby making it possible to perform display as desired.

Also, in recent years, a scheme has been proposed to arrange D/A converters for every data line to convert gray scale data indicating the gray level of a pixel into an analog signal. With this scheme, image data is digitally processed immediately before it is output to the data line, thus deterioration of the display quality due to variations in analog circuit characteristics is prevented, thereby making it possible to obtain a high quality display.

For performing gray-scale display, it is necessary to apply a voltage with a range corresponding to values from the minimum gray level to the maximum gray level to the pixel electrodes in two separate ways, namely, positive polarity and negative polarity. Accordingly, the swing voltage between the minimum value and the maximum value which is required to be applied to a pixel electrode becomes greater than the swing of the logic level of CMOS circuits and so on.

SUMMARY OF THE INVENTION

However, increasing the swing voltage applied to the pixel electrode inevitably results in an increase in the swing voltage applied to the data line. If the swing voltage applied to the data line is increased, electrical power is wastefully consumed by a parasitic capacitance on the data line. Such a result is contrary to the demands generally made on liquid crystal devices for lowering the power consumption.

Also, when the swing voltage applied to the data line is increased, the output swing voltage from the D/A converter needs to be increased. Thus, the composition of the D/A converter becomes large, or a separate level shifter becomes necessary to amplify the output voltage.

Accordingly, the present invention is made in view of the foregoing, and an object of the invention is to keep the swing voltage applied to various signals, especially a data line, small, thereby providing a liquid crystal device, a driving circuit, a driving method, and electronic devices which are intended to reduce power consumption.

In order to accomplish the above-described object, in a liquid crystal device according to a first aspect of the present invention, there is provided a liquid crystal device including a scanning line to which an on-voltage is applied and then an off-voltage is applied, a liquid crystal capacitor having a liquid crystal sandwiched between a counter electrode and a pixel electrode, a D/A converter applying a voltage, which corresponds to gray scale data indicating a gray level and to a writing polarity of the liquid crystal, to a data line when an on-voltage is applied to the scanning line, and a switching element inserted between the data line and the pixel electrode, the switching element being turned on when the on-voltage is applied to the scanning line, and being turned off when an off-voltage is applied.

The liquid crystal device can further include a storage capacitor having one terminal connected to the pixel electrode, wherein, when the writing polarity during the period when the on-voltage is applied to the scanning line is equivalent to positive-polarity writing, the voltage of the other terminal is shifted to a high level when the off-voltage is applied to the scanning line, and when the writing polarity during the period when on-voltage is applied to the scanning line is equivalent to negative-polarity writing, the voltage of the other terminal is shifted to a low level when the off-voltage is applied to the scanning line.

With this arrangement, when on-voltage is applied to the scanning line, the switching element connected to the scanning line can be turned on, thereby the charge corresponding to the applied voltage is stored to the liquid crystal capacitor and storage electrode. When the switching element is turned off thereafter, the voltage of the other terminal of the storage capacitor shifts, and the voltage of one terminal of storage capacitor is raised by that amount (or lowered). At the same time, the amount of charge raised (or lowered) is distributed to the liquid crystal capacitor, thus the voltage effective value corresponding more than (or less than) the applied voltage to the data line is applied to the liquid crystal capacitor. In other words, when compared with the swing voltage applied to the pixel electrode, the swing voltage of the voltage signal applied to the data line is kept small. Thus, wasteful power consumption by parasitic capacitor on the data line is kept small, thereby making it possible to reduce power consumption. Additionally, enlarging the D/A converter is prevented, or level shifter for enlarging the output voltage of a D/A converter becomes unnecessary, thereby making it possible to narrow the pitch of a data line so as to achieve high precision.

Here, in the first aspect of the present invention, it is preferable to have the arrangement that in the case where the writing polarity is one of positive polarity writing and negative polarity writing, the display device further can further include a first power feeding line which is fed with a first voltage during a preset period, and which is fed with a second voltage which is higher than the first voltage during a set period after the preset period, a second power feeding line which is fed with a third voltage which is higher than the second voltage during the preset period, and which is fed with a fourth voltage which is lower than the third voltage and higher than the second voltage during the set period, and a selector to select one of the first and second power feeding lines during the preset period, and to select the other one of the first and second power feeding lines during the set period, wherein the D/A converter generates a supply voltage to the data line using the corresponding voltage selected by the selector during the preset period and the set period.

If the D/A converter is arranged such that in the case of using a first voltage during preset period, it uses a fourth voltage during the set period, whereas in the case of using a third voltage during the preset period, it uses a second voltage during the set period, the arrangement can be simply considered such that the first and fourth voltage is applied via one power feeding line, whereas the third and second voltage is applied via the other one line.

However, in such an arrangement, the swing voltage of two power feeding lines increases, thus the power is wastefully consumed by the parasitic capacitor on these lines.

Accordingly, at the time of transition from the preset period to the set period, if it is arranged such that the selector switches power feeding from one to the other one of the first and second power feeding lines, the voltage transition of both power feeding lines are kept small, thus power consumption can be reduced further more.

In addition, in the arrangement of switching power feeding from one to the other one of the first and second power feeding lines by the selector, it is also preferable that, in the case where the writing polarity is the other one of positive-polarity writing and negative-polarity writing, the first power feeding line is fed with a fifth voltage during the preset period, and is fed with a sixth voltage which is higher than the fifth voltage during the set period after the preset period, whereas the second power feeding line is fed with a seventh voltage which is higher than the sixth voltage during the preset period, and is fed with an eighth voltage which is lower than the seventh voltage and higher than the sixth voltage during the set period. In this arrangement, the voltage transition of both power feeding lines are kept small not only at the transition from the preset period to the set period, but also the transition of writing polarity from one to the other one of positive-polarity writing and negative-polarity writing.

Also, a D/A converter according to the first aspect preferably includes, in the case where the writing polarity is one of positive-polarity writing and negative-polarity writing, a first switch that applies either a first or third voltage to the data line corresponding to upper bits of the gray scale data during a preset period, and a capacitor having a capacitance corresponding to the lower bits excluding the upper bits from the gray scale data, wherein, in the case where the first voltage is applied to the data line, a fourth voltage which is higher than the first voltage is applied to one terminal, whereas, in the case where the third voltage is applied to the data line, a second voltage which is higher than the third voltage is applied to one terminal, and the other terminal is connected to the data line during a set period after the preset period.

In this arrangement, when the first or third voltage is applied to the data line by the first switch depending on the upper bits of gray scale data during the preset period, the charge corresponding to the applied voltage is stored in the parasitic capacitance of the data line. Then, during the set period, the capacitance corresponding to the lower bits of the gray scale data, and the fourth or second voltage is applied to one terminal of the capacitor, and the other terminal is connected to the data line, the charge stored in the capacitor moves to the parasitic capacitor of the data line, or on the contrary, the charge stored in the parasitic capacitor of the data line moves to the capacitor, and the voltages level off. As a result, the voltage corresponding to gray scale bits is applied to the data line. This means that at the time of performing D/A conversion, the parasitic capacitor of the data line is utilized, thereby simplifying the structure.

In this case, there is an arrangement that a capacitor of D/A converter includes a bit capacitor corresponding to weighting of the lower bits, and a second switch which is arranged corresponding to the bit capacitor, and is turned on or off depending to the lower bits. With this arrangement, it is easy to form a capacitor having the capacity corresponding to the lower bits of the gray scale data.

If the D/A converter which includes a first switch and capacitor is arranged such that in the case of using a first voltage during preset period, the converter uses the fourth voltage during set period, whereas in the case of using the third voltage during preset period, the converter uses the second voltage during set period, the arrangement can be simply considered such that the first and fourth voltage is applied via one power feeding line, whereas the third and second voltage is applied via the other one line.

However, in such arrangement, the swing voltage of two power feeding lines becomes large, thus the power is consumed worthlessly by the parasitic capacitor on these lines.

Thus, in the arrangement in which a D/A converter includes a first switch and capacitor, it is preferable that the converter includes a first power feeding line which is fed with the first voltage during the preset period, and which is fed with the second voltage during the set period, a second power feeding line which is fed with the third voltage during the preset period, and which is fed with the fourth voltage during the set period, and a selector which selects either one of the first power feeding line or the second power feeding line depending on the upper bits, and supplies the voltage which is fed to the selected power feeding line to the input terminal of the first switch during the preset period, and which selects the other one of the first power feeding line or the second power feeding line during the preset period, and feeds the voltage which is fed to the selected power feeding line to one terminal of the capacitor.

In this arrangement, the voltage transition from the preset period to the set period, the power feeding is switched from one to the other one of the first and second power feeding lines by the selector, thus the voltage transition in both power feeding lines are kept small. As a result, power consumption can be further reduced.

Also, in the D/A converter, it is preferable to arrange that, in the case where the writing polarity is the other one of positive-polarity writing and negative-polarity writing, the first switch supplies one of a fifth voltage or a seventh voltage to the data line depending on the upper bits of the gray scale data during the preset period, and one terminal of the capacitor is supplied with an eighth voltage which is higher than the fifth voltage in the case where the data line is supplied with the fifth voltage, whereas one terminal of the capacitor is supplied with a sixth voltage which is lower than the seventh voltage in the case where the data line is supplied with the seventh voltage.

With this arrangement, only by changing the applied voltage during the preset period and the set period, the voltage corresponding to the writing polarity to liquid crystal capacitor can be generated.

Additionally, in the case where a D/A converter changes the applying voltage during the preset period and the set period so as to generate the voltage corresponding to the writing polarity to liquid crystal capacitor, it is preferable that a first power feeding line fed with a fifth voltage during the preset period, and is fed with a sixth voltage during the set period, whereas a second power feeding line is fed with the seventh voltage during the preset period, and being fed with the eighth voltage during the set period. In this arrangement, the voltage transition of both power feeding lines are kept small not only at the transition from the preset period to set period, but also the transition of writing polarity from one to the other one of positive-polarity writing to negative-polarity writing.

At the same time, in the first aspect of the present invention, if the storage capacitor is much larger than the liquid crystal capacitor, the shifted amount of the other terminal of the storage capacitor can be assumed to be applied to the liquid crystal capacitor. However, in practice, there is a limit that the storage capacitor is less than several fold amount of the liquid crystal capacitor, thus the voltage shift amount of the other terminal of the storage capacitor is compressed and applied to the liquid crystal capacitor. If the ratio of the capacitance of the storage capacitor to the liquid crystal capacitor is four or more, the decrease amount of the swing voltage is as little as less than 20%, which is realistic from the layout consideration.

Also, in the first aspect of the present invention, it is preferable that the other terminal of the storage capacitor is commonly connected per each line via a capacitor line. With this arrangement, the liquid crystal capacitor can be inverted for every scanning line (row inversion) or inverted for every vertical scanning period (frame inversion).

Furthermore, the electronic devices according to the present invention are equipped with the above-described liquid crystal display devices, thereby making it possible to reduce power consumption. In this regard, these devices include projectors for extended projection of images, personal computers, and mobile phones.

In this regard, the first aspect described above can be accomplished as a driving circuit for a liquid crystal display device. Specifically, a driving circuit for a liquid crystal display device according to a second aspect of the present invention, in which the display device includes, a liquid crystal capacitor arranged at the intersection of a scanning line and a data line, and having a liquid crystal sandwiched between a counter electrode and pixel electrode, a switching element inserted between the data line and the pixel electrode, the switching element being turned on when an on-voltage is applied to the scanning line, and being turned off when an off-voltage is applied to the scanning line, and a capacitor of which one terminal is connected to the pixel electrode, the driving circuit includes a scanning line driving circuit applying the on-voltage to the scanning line, and then applying the off-voltage to the scanning line, a D/A converter applying a voltage corresponding to gray scale data indicating a gray level, and corresponding to a writing polarity of the liquid crystal, to a data line when the scanning line driving circuit applies the on-voltage to the scanning line, and a storage capacitor driving circuit wherein, when, in the case of applying the on-voltage to the scanning line, the voltage applied to the data line is equivalent to positive-polarity writing, then the voltage of another terminal is shifted to high when the off-voltage is applied to the scanning line, and when in the case of applying the on-voltage to the scanning line, the voltage applied to the data line is equivalent to negative-polarity writing when the off-voltage is applied to the scanning line, then the voltage of the other terminal of the storage capacitor is shifted to low.

With this arrangement, in the same manner as the first aspect of the present invention, compared with the swing voltage applied to the pixel electrode, the swing voltage applied to the voltage signal of the data line can be kept small, thereby making it possible to reduce power consumption, and at the same time the pitches of the data line can be narrowed to achieve high precision.

Additionally, the first aspect described above can be accomplished as a driving method for a liquid crystal display device. Specifically, a driving method for a liquid crystal display device according to a third aspect of the present invention, in which the display device includes a liquid crystal capacitor arranged at the intersection of a scanning line and a data line, and having a liquid crystal sandwiched between a counter electrode and pixel electrode, and a switching element inserted between the data line and the pixel electrode, the switching element being turned on when an on-voltage is applied to the scanning line, and being turned off when an off-voltage is applied to the scanning line, and a capacitor of which one terminal is connected to the pixel electrode.

The driving method can include applying an on-voltage to the scanning line, applying a voltage corresponding to gray scale data indicating a gray scale, and corresponding to a writing polarity of the liquid crystal to a data line, applying off-voltage to the scanning line if the writing polarity to the data line is equivalent to positive-polarity writing, shifting the voltage of another terminal to high, and if the writing polarity to the scanning line is equivalent to negative-polarity writing, shifting the voltage of the other terminal of the storage capacitor to low when the off-voltage is applied to the scanning line.

With this arrangement, in the same manner as the first and second aspects of the present invention, compared with the swing voltage applied to the pixel electrode, the swing voltage applied to the voltage signal of the data line can be kept small, thereby making it possible to reduce power consumption, and at the same time the pitches of the data line can be narrowed to achieve high precision.

BRIEF DESCRIPTION OF THE DRAWINGS

The invention will be described with reference to the accompanying drawings, in which like elements are referred to with like numbers, and which:

FIG. 1(*b*) is a cross-sectional view taken on line A–A' of FIG. 1(*a*);

FIG. 3(*a*) is a truth table showing the logic level of a signal $C_{set1}$ for a signal PS and signal $C_{set}$;

FIG. 3(*b*) is a truth table showing the logic level of a signal $\overline{C}_{set1}$ for a signal PS and signal $C_{set}$;

FIG. 4 is a truth table showing the decoding result of a second decoder in the liquid crystal display device;

FIG. 5 is a truth table showing the decoding result of a third decoder in the liquid crystal display device;

FIG. 14(*b*) shows voltage waveforms applied to pixel electrodes;

DETAILED DESCRIPTION OF PREFERRED EMBODIMENTS

Figure 1:
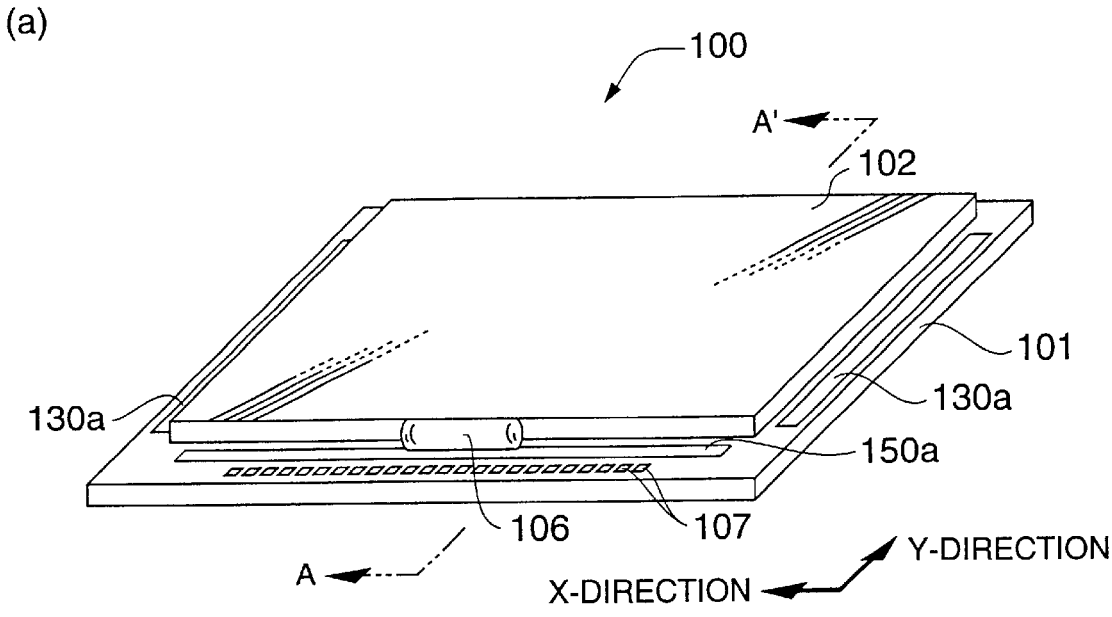
FIG. 1(*a*) is a perspective view showing the external structure of a liquid crystal display device according to an embodiment of the present invention.
Figure 1:
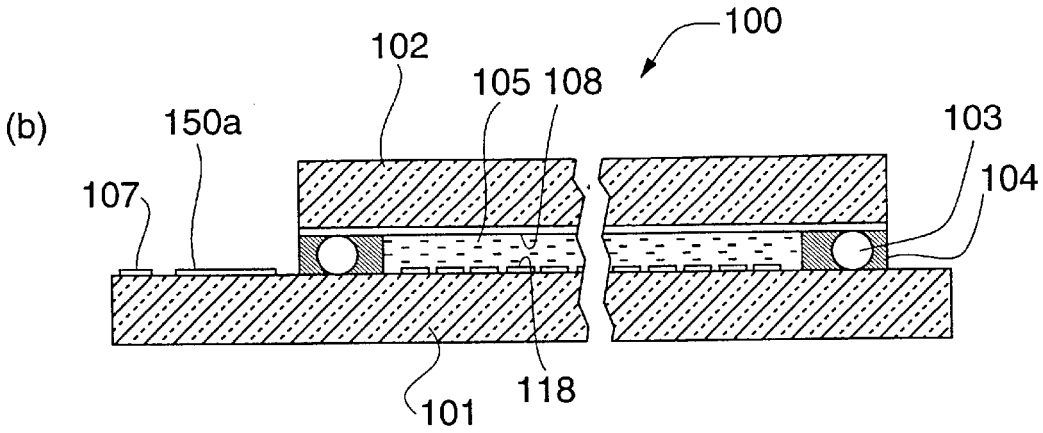

FIG. 1(*a*) is a perspective view showing the structure of a liquid crystal display device according to an embodiment of the present invention, and FIG. 1(*b*) is a cross-sectional view taken on line A–A' of FIG. 1(*a*).

As shown, the liquid crystal display device 100 is formed with an element substrate on which various elements and pixel electrodes 118 are arranged and a counter substrate on which counter electrodes 108 and so on are arranged. The substrates are bonded together such that a certain gap is kept by sealing material 104 containing spacers 103 therebetween and the surfaces having the electrodes formed thereon faces each other, and in the gap, for example, a TN (Twisted Nematic) type liquid crystal 105 is enclosed.

In this embodiment, the element substrate includes a transparent substrate, such as glass, semiconductor, and quartz, but can be composed of an opaque substrate. However, if the element substrate 101 is composed of an opaque substrate, the display device needs to be of a reflection type, not a transmission type. Also, a sealing material 104 is formed along the outer periphery of the counter substrate 102, and has an opening to enclose the liquid crystal 105. Accordingly, the opening is sealed by the sealing material 106 after enclosing the liquid crystal 105.

Next, on the opposing surface of the element substrate 101, in the area 150*a* located along an outer edge of the sealing material 104, a circuit for driving the data line is formed (details will be described in the following). And at the outer edge, a plurality of package terminals 107 is formed to which various signals are input from external circuits.

Also, in the area 130*a* located adjacent to this edge, circuits that drive scanning lines and capacitor lines are formed (details will be described in the following) to drive them from both sides in the row (X) direction. Also, on the remaining edge, wiring lines which are shared by the circuits formed in the two areas 130*a* are arranged.

In this regard, if the delay of the signal supplied in the row direction is not a problem, the circuit which outputs these signals may be placed on only one area 130*a*.

Now, the counter electrodes 108 arranged on the counter substrate 102 are electrically connected using conductive material such as silver paste to the package terminal 107 formed on the element substrate 101 in at least one place out of the four corners of parts laminated with the element substrate 101, and are formed such that a constant voltage $LC_{com}$ is always applied.

In addition, on the counter substrate 102, a color filter can be disposed in the area facing the pixel electrodes 118 as necessary, although it is not particularly shown in the figure. However, when used as a light modulator, such as in a projector described below, it is not necessary to form a color filter on the counter substrate. Also, in order to prevent deterioration of the contrast ratio caused by leaking light, a light blocking filter can be disposed in the portion of the area not facing the pixel electrodes 118 (not shown in the figure).

Also, on each of opposing surfaces of the element substrate 101 and the counter substrate 102, an alignment layer processed by rubbing is disposed in such a manner that the longitudinal directions of molecules are twisted at about 90 degrees between both of the substrates, whereas on each of the back sides, a light polarizer is disposed such that the absorption axis is along the orientation direction. As a result, if the effective voltage applied to the liquid crystal capacitor (capacitor of the liquid crystal 105 sandwiched between pixel electrode pixel electrodes 118 and counter electrode 108) is zero, the transmittance reaches its maximum, whereas as the effective voltage increases, the transmittance gradually decreases, and finally reaches its minimum. This means that the liquid crystal display device according to the present embodiment is formed in the normally white mode.

In this regard, the alignment layer and light polarizer are not directly related to the present embodiment, so that their illustration in the figure is omitted. Also, in FIG. 1(*b*), the counter electrode 108, pixel electrode pixel electrodes 118, and package terminals 107 have a thickness, but this is for the sake of convenience, and in practice they are so thin as to be invisible.

Figure 2:
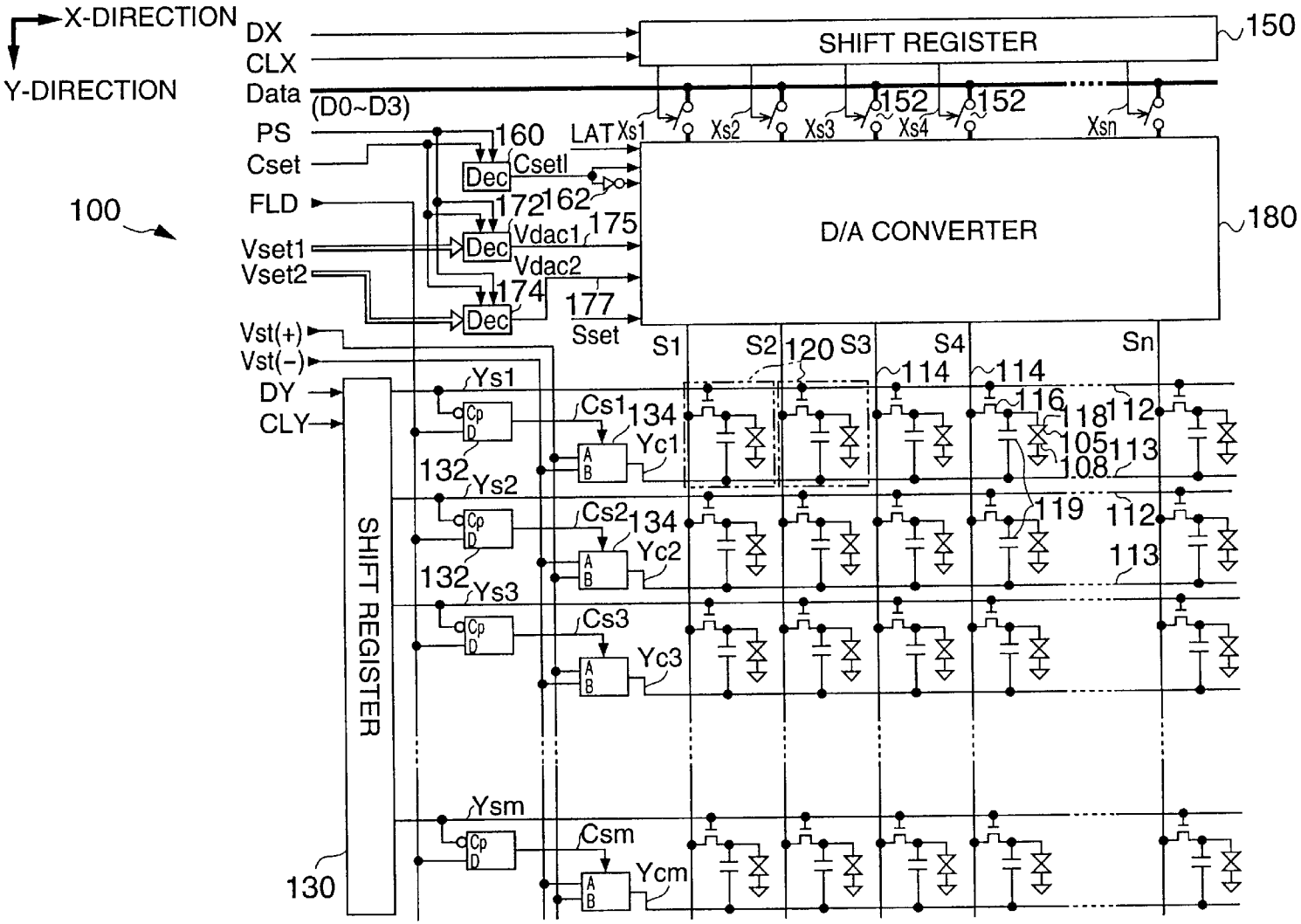
FIG. 2 is an exemplary block diagram showing the electrical structure of the liquid crystal display device.

In the following, the electrical structure of the liquid crystal display device will be described. FIG. 2 shows an exemplary block diagram of the electrical structure. As shown in the figure, scanning lines 112 and capacitor lines 113 are formed to extend in the X (row) direction, data lines 114 are formed to extend in the Y (column) direction, and pixels are formed at their intersections. Here, for the sake of explanation, given that the number of the scanning lines 112 (capacitor lines 113) is "m" and the number of the data lines 114 is "n", the pixels are arranged in a matrix with m rows and n columns. Also, in the present embodiment, m and n are shown as even numbers in the figure, however, it is to be understood they are not limited in this manner.

Next, when turning attention to one electrode 120, the gate of an N-channel-type Thin Film Transistor (TFT) 116 is connected to the scanning line 112, the source is connected to the data line 114, and the drain is connected to one end of pixel electrode 118 and storage capacitor 119.

As described above, the pixel electrode 118 faces the counter electrode 118, and the liquid crystal 105 is sandwiched between both electrodes. Therefore, the liquid crystal capacitor is formed sandwiching the liquid crystal 150 with one end thereof formed as the pixel electrode 118, and the other end as the counter electrode 108.

With this arrangement, when the scanning signal supplied to the scanning line 112 becomes H, TFT116 is turned on, and the charge corresponding to the voltage of the data line 114 is written to the liquid crystal capacitor and the storage capacitor 119. In this regard, the other end of the storage capacitor 119 is connected to every row of the capacitor line 113 in common.

Figure 8:
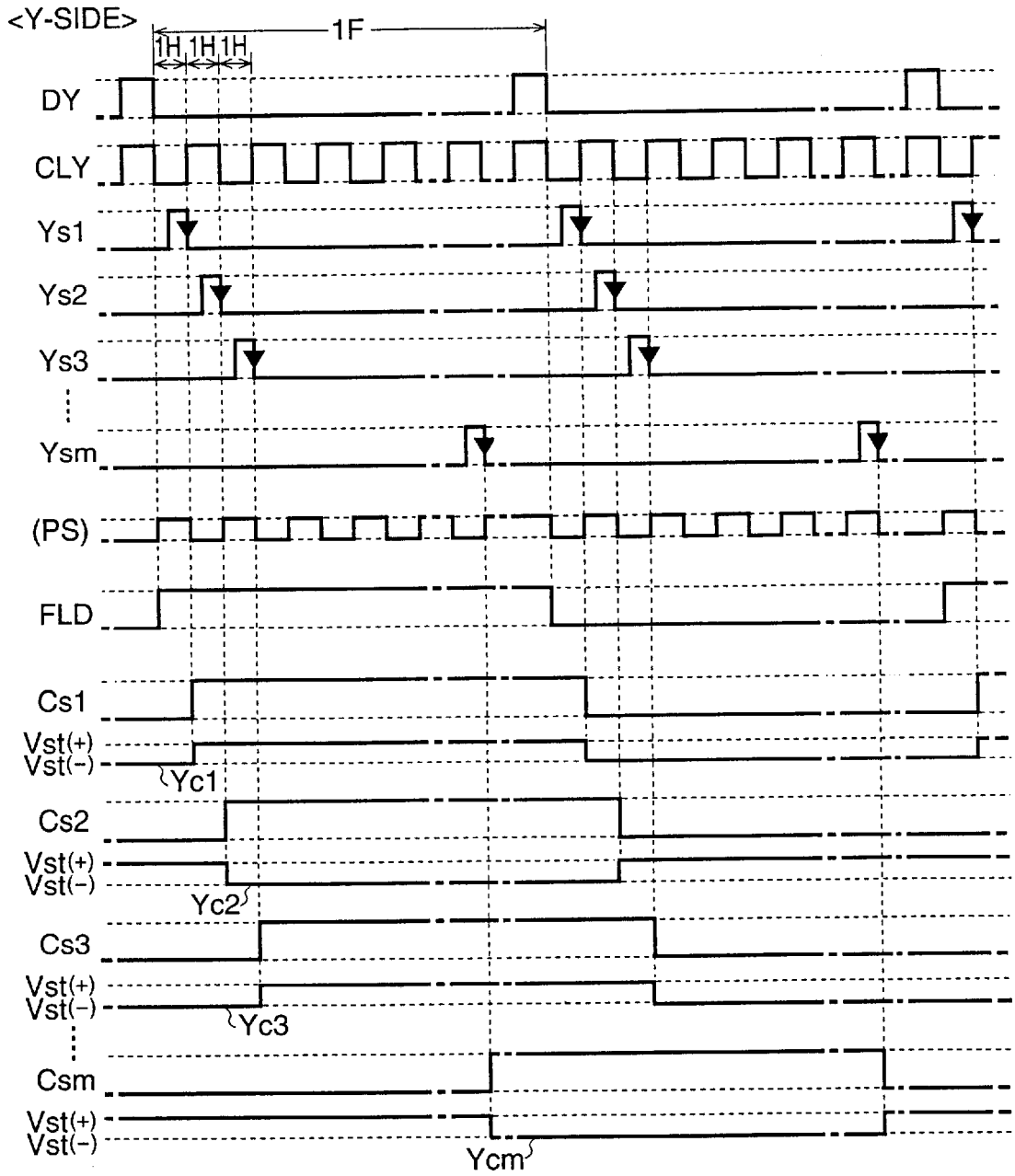
FIG. 8 is a timing chart illustrating the operation of the Y-side in the liquid crystal display device.

Now, when turning attention to Y-side, a shift register 130 (scanning line driving circuit) is disposed. As shown in FIG. 8, the shift register 130 shifts the transmission start pulse, DY, which is supplied at the start of one vertical scanning period (1F), in sequence at a rise and fall of the clock signal CLY to produce the scanning signals Ys1, Ys2, Ys3, . . . , Ysm to be supplied to the first, second, third, . . . , and the mth row, respectively, of the scanning line 112. Here, as shown in FIG. 8, the scanning signals Ys1, Ys2, Ys3, . . . , Ysm becomes the active level (H) every one horizontal scanning period (1H) such that the transmission start pulses, DY can be narrowed in width, and are not overlapped with each other.

Next, a flipflop 13 and selector 134 (storage capacitor driving circuit) is provided for every row. Here, in general, a clock-pulse input terminal $C_p$ of the flipflop 132 corresponding to i (i is an integer satisfying $1 \leqq i \leqq m$) is supplied with the inverted signal of the scanning signal $Y_{si}$ which corresponds to the row i, and the data input terminal D is supplied with the signal FLD, the logic level is inverted every one vertical scanning period (1F) (Refer to FIG. 8). Thus, the flipflop 132 of the row i latches the signal FLD at a fall of scanning signal $Y_{si}$ to output a selection control signal $C_{si}$.

Then, in general, the selector 134 of the row i selects an input terminal A if the logic level of the selection control signal $C_{si}$ is H, and selects an input terminal B if the logic level of the selection control signal $C_{si}$ is L, and then outputs the selected signal to either of the input terminals to output to a capacitor line 113 as a capacitor swing signal $Y_{ci}$.

Among the selectors 134 provided for every row, high capacitor voltage $V_{st}((+))$ is applied to the input terminal A of the selector 134 of the odd row number, and low capacitor voltage $V_{st}(-)$ is applied to its input terminal B. On the contrary, low capacitor voltage $V_{st}(-)$ is applied to the input terminal A of the selector 134 of the even row number, and high capacitor voltage $V_{st}((+))$ is applied to its input terminal B.

This means that the capacitor voltages applied to the input terminals A and B have an opposite relationship with respect to each other at the selector 134 of the odd row number and the selector 134 of the even row number.

Now, when turning attention to the X-side, a decoder (in FIG. 2, denoted by "Dec") 160 decodes a signal PS and $C_{set}$, and outputs a signal $C_{set1}$ having a logic level corresponding to the truth table shown in FIG. 3(*a*).

Also, an inverter 162 inverts the logic level of the signal $C_{set1}$ to output a signal $\overline{C}_{set1}$. In this regard, FIG. 3(*b*) shows a truth table when the signals PS and $C_{set}$ are input and the output is the signal $\overline{C}_{set1}$.

Figure 10:
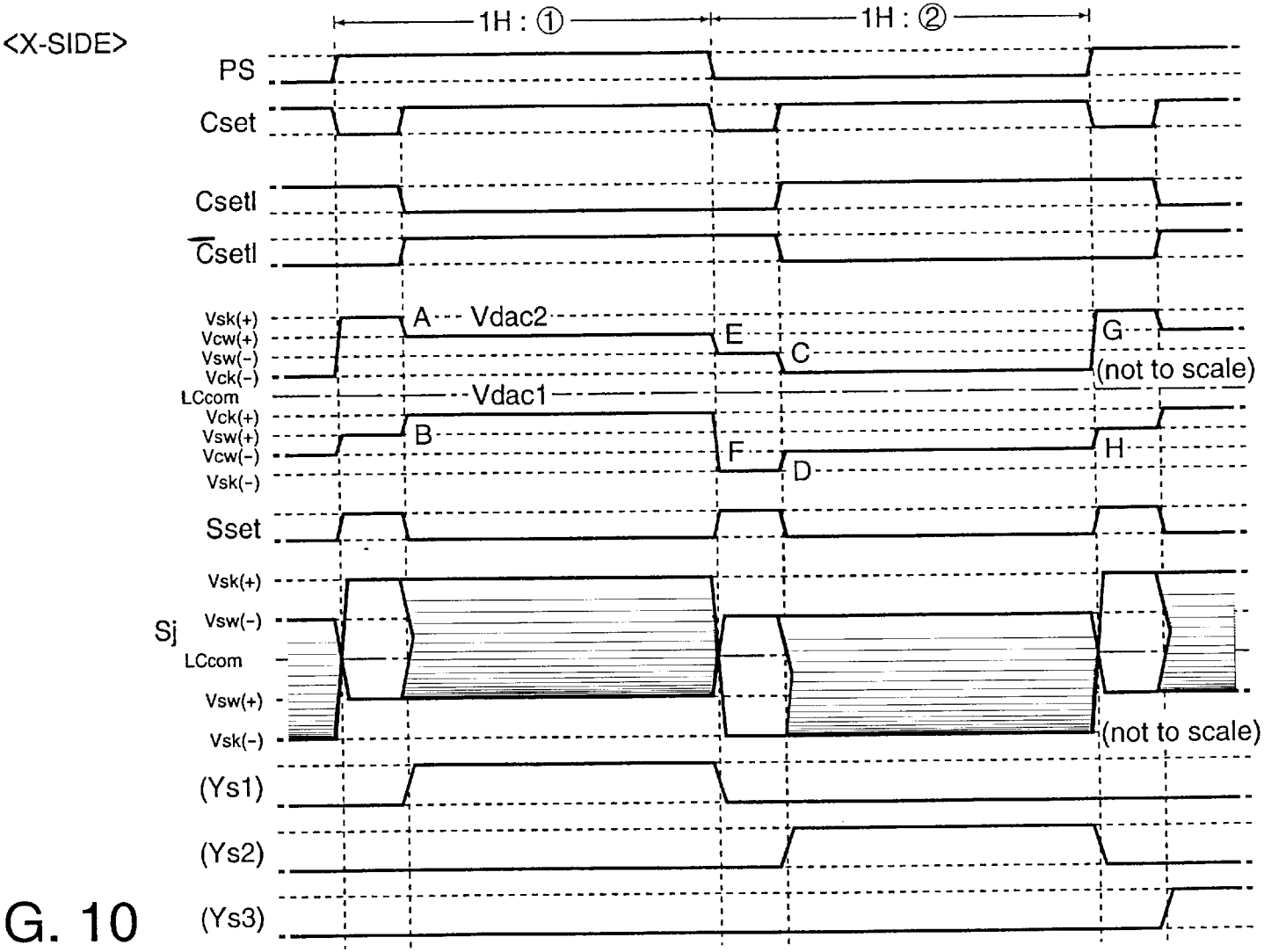
FIG. 10 is a timing chart illustrating the operation of the X-side in the liquid crystal display device.

Here, the signal PS is a signal directing the writing polarity to the liquid crystal capacitor, and if the logic level is H, it specifies positive-writing polarity, whereas if the logic level is L, it specifies negative-writing polarity. In the present embodiment, the logic level of the signal PS is inverted every horizontal scanning period (1H) as shown in FIG. 8 or FIG. 10. Additionally, the logic level of the signal PS is inverted every vertical scanning period within the same horizontal scanning period (refer to the signal in parentheses). Specifically, in the present embodiment, it is arranged that the polarity is inverted by the scanning line 112.

Also, as shown in FIG. 10, the signal $C_{set}$ becomes L in the period just before the scanning signals $Y_{S1}$, $Y_{S2}$, $Y_{S3}$, . . . , $Y_{Sm}$ becomes H, and it becomes H in the other periods within one horizontal scanning period (1H).

In this regard, in the present embodiment, a polarity inversion of the pixel 120 or liquid crystal capacitor means that setting the voltage $LC_{corn}$ applied to the other terminal of the liquid crystal capacitor, which is the counter electrode 108, as a reference, the applied voltage to one terminal of the liquid crystal capacitor, which is the pixel electrode 118, is alternatively inverted.

However, in the present invention, if the voltage applied to the pixel electrode 118 by the turning on of TFT116 is lower than the voltage $LC_{com}$ applied to the counter electrode 108, as described below, after TFT116 is turned off, the voltage of pixel electrode 118 is shifted to high, the voltage may be higher than $LC_{com}$ as a result.

Specifically, in the present embodiment, even if the voltage lower than $LC_{com}$ is applied to the data line 114, the voltage may correspond to positive polarity writing.

On the other hand, in the present invention, if the voltage applied to the pixel electrode 118 by the turning on of TFT116 is higher than the voltage $LC_{com}$ after TFT116 is turned off, the voltage of pixel electrode 118 shifts to low, the voltage may be lower than $LC_{com}$ as a result.

Specifically, in the present embodiment, even if a voltage higher than $LC_{com}$ is applied to the data line 114, the voltage may correspond to negative-polarity writing.

Next, a decoder 172 decodes a signal PS and $C_{set}$, and supplies a voltage signal corresponding to the decoding result shown in FIG. 4 as a gray scale signal $V_{dac}$1 to a first power feeding line 175. Here, the voltage of the gray scale signal Vdacl can be one of the $V_{sw}((+))$, $V_{ck}((+))$, $V_{sk}(-)$, and $V_{cw}(-)$, thus these four voltages are applied as voltage signal group $V_{set}$1 to the input terminal of the decoder 172.

Then a decoder 174 decodes a signal PS and $C_{set}$, and supplies a voltage signal corresponding to the decoding result shown in FIG. 5 as a gray scale signal $V_{dac}$2 to a second power feeding line 177. Here, the voltage of the gray scale signal $V_{dac}$ 2 can be one of $V_{sk}((+))$, $V_{cw}((+))$, $V_{sw}(-)$, and $V_{ck}(-)$, thus these four voltages are applied as voltage signal group $V_{set}$2 to the input terminal of the decoder 174. In this regard, a description about the voltage of the gray scale signals $V_{set}$1 and $V_{dac}$2 will be given below.

Figure 9:
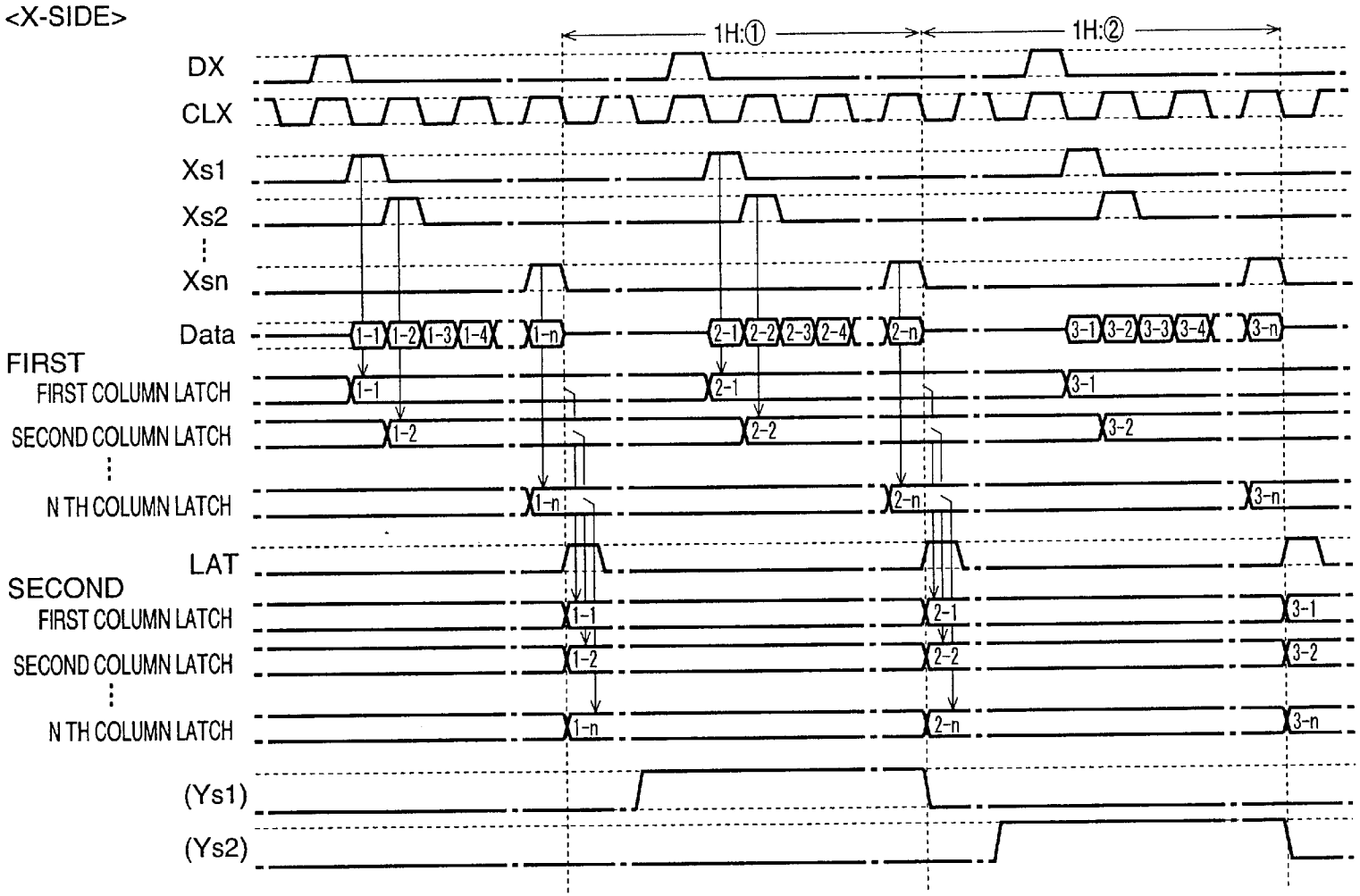
FIG. 9 is a timing chart illustrating the operation of the X-side in the liquid crystal display device.

Moreover, as shown in FIG. 9, the shift register 150 shifts the transmission start pulse, DX, in sequence at a rise and fall of the clock signal CLX to output sampling control signals $X_{S1}, X_{S2}, X_{S3}, \ldots, X_{Sn}$ to be active (H) in a mutually exclusive manner. Here, the sampling control signals $X_{S1}$, $X_{S2}, X_{S3}, \ldots, X_{Sn}$ become active (H) in sequence without overlapping one another.

Now, at the output side of the shift register 150, a first sampling switch 152 is provided corresponding to each column of the data line 114. Among these, in general, a first sampling switch 152 corresponding to the column j (j is an integer satisfying $1 \leqq j \leqq n$) turns on when a sampling control signal $X_{sj}$ becomes H to sample the gray scale data.

Here, gray scale data, Data, is 4-bit digital data specifying the gray scale (density) of the pixel 120, and is supplied in synchronization with a clock signal CLX via the package terminal 107 (refer to FIG. 1(*a*) or FIG. 1(*b*)) from the external circuit not shown in the figure. Thus, in the liquid crystal display device according to the present embodiment, the pixel 120 displays 16 ($=2^4$) gray shades according to the 4-bit gray scale data, Data.

In this regard, for the sake of explanation, among the gray scale data, Data, the most significant bit is denoted by D3, and the next significant bit is denoted by D2, and the third significant bit is denoted by D1, and the least significant bit is denoted by D0.

Also, in FIG. 2, the shift register 130, flipflop 132, and selector 134 are arranged only on the left side of the array area of the pixels 120, but in practice, as shown in FIG. 1, they can be disposed symmetrically about the array of the pixels 120, and can be arranged to drive the scanning line 112 and capacitor line 113 from both the right and left sides, respectively.

Next, D/A converter group 180 in FIG. 2 converts the gray scale data, Data, sampled by the first sampling switches 152, each of which corresponds to the first column, second column, third column, . . . , nth column, into analog signal to be output as data signals S1, S2, S3, . . . , and Sn, respectively.

Figure 6:
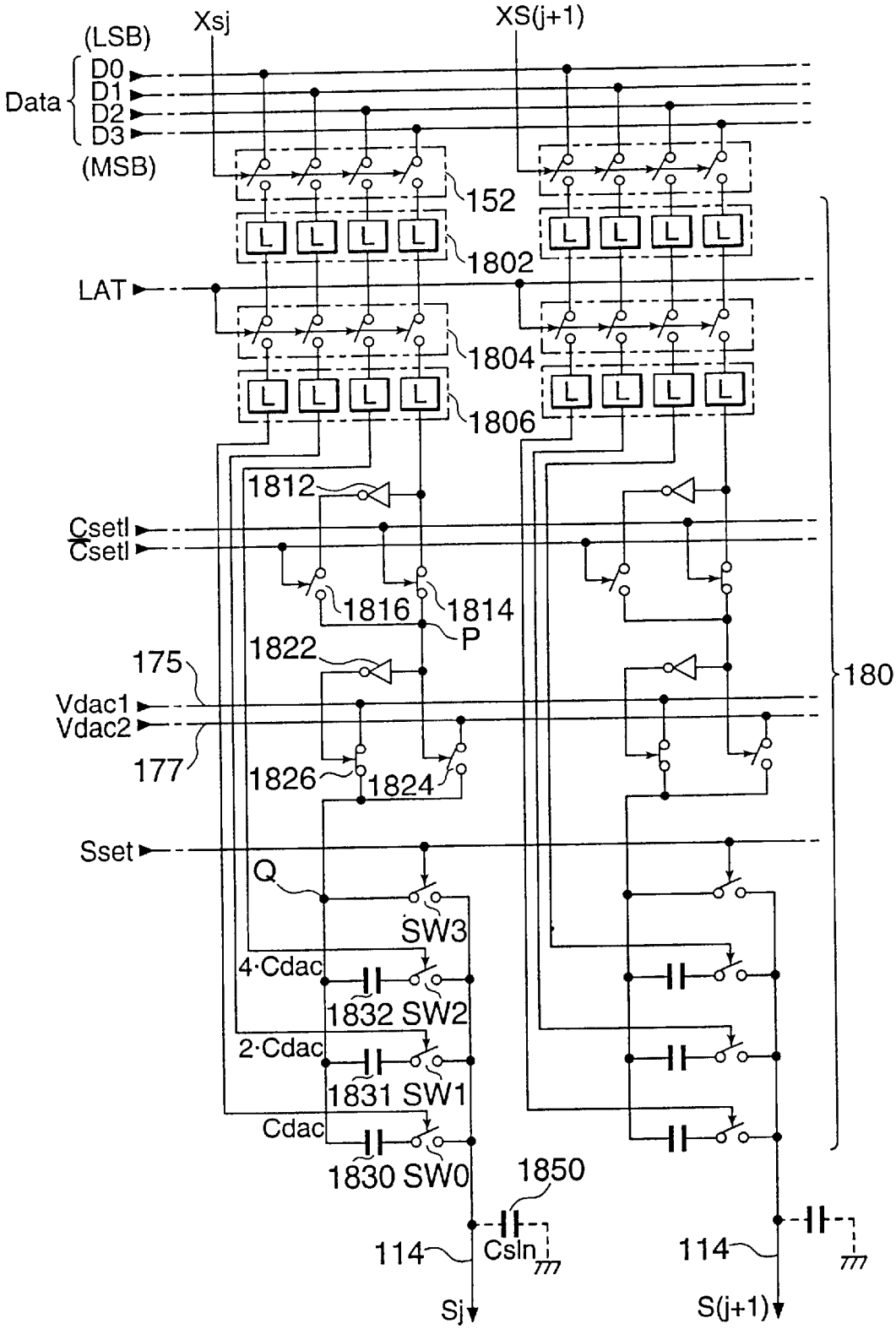
FIG. 6 is an exemplary block diagram showing the structure of the D/A converter in the liquid crystal display device.

Here, for the D/A converter group 180, the structure of all columns are the same as each other, thus in general, a description will be given of the structure corresponding to the column j. FIG. 6 is an exemplary block diagram showing the structure including the part of two columns, the column j and its adjacent column (j(+)1), and a first sampling switch 152 of the D/A converter group 180.

In the figure, a first latch circuit 1802 corresponding to the column j latches the bits D0 to D3 of the gray scale data, Data, sampled by the first sampling switch 152 corresponding to the column j.

Then, a second sampling switch 1804 corresponding to the column j samples respectively the bits D0 to D3 of the gray scale data, Data, latched by the first latch circuit 1802 corresponding to the column j when a latch pulse LAT becomes active (H level).

Further, a second latch circuit 1806 corresponding to the column j latches the bits D0 to D3 of the gray scale data, Data, sampled by the second sampling switch 1804 corresponding to the column j.

Next, among the bits latched by the second latch circuit 1806, the signal lines of the lower three bits D0, D1, and D3 are connected to the control terminals of switches SW0, SW1, and SW2, respectively. These switches SW0, SW1, and SW2 (second switches) turn on when the bits latched by the second latch circuit 1806 are "1" (H).

Moreover, among the bits latched by the second latch circuit 1806, the signal lines supplying the most significant bit D3 are connected to the input terminals of a switch 1814 and inverter 1812, and the output terminal of the inverter 1812 is connected to an input terminal of a switch 1816. And the output terminals of switch 1814 and 1816 are connected to a node P in common. Here, the control terminal of the switch 1814 is connected to a signal line to which the signal $C_{set}$1 is supplied, whereas the control terminal of the switch 1816 is connected to a signal line to which the signal $\overline{C}_{set1}$ is supplied.

Each of the switches 1814 and 1816 according to the present embodiment turns on when the signal supplied to the control terminal is H. Since the signal $\overline{C}_{set1}$ is an inverted signal of the logic level of the signal $C_{set}$1, the switches 1814 and 1816 are turned on and off in a mutually exclusive manner.

Accordingly, the logic level of a node P is equal to that of a non-inverted signal of the most significant bit, D3, latched by the second latch circuit 1806 when the signal $C_{set}$1 becomes high to turn the switch 1814 on (when the signal $\overline{C}_{set1}$ becomes low to turn the switch 1816 off), whereas when the signal $\overline{C}_{set1}$ becomes high to turn the switch 1816 on (when the signal $C_{set}$1 becomes low to turn the switch 1814 off), the logic level is equal to that of a inverted signal of the most significant bit, D3, which is latched.

Then, the node P is connected to a control terminal of a switch 1824 and the input terminal of an inverter 1822, and the output terminal of the inverter 1822 is connected to the control terminal of the switch 1826. The output terminals of the switches 1824 and 1826 are connected to the common node Q.

Here, the input terminal of the switch 1824 is connected to a second power feeding line 177 to which a gray scale signal $V_{dac}$2 is supplied, whereas the input terminal of the switch 1826 is connected to a first power feeding line 175 to which a gray scale signal $V_{dac}$1 is supplied.

Each of the switches 1824 and 1826 according to the present embodiment turns on when the signal supplied to the control terminal is H. Since the signal supplied to the control terminal of the switch 1826 is an inverted signal of the logic level of the signal supplied to the control terminal of the switch 1824 by the inverter 1822, the switches 1824 and 1826 are turned on and off in a mutually exclusive manner.

Consequently, when the node P is H, the switch 1824 turns on, and the switch 1826 turns off, thus a node Q will be at the voltage of the gray scale signal $V_{dac}$2, and when the node P is L, the switch 1824 turns off, and the switch 1826 turns on, thus a node Q will be at the voltage of the gray scale signal $V_{dac}$1.

Specifically, all of the inverters 1812 and 1822, and switches 1814, 1816, 1824, and 1826 select one of the first power feeding line 175 and the second power feeding line 177 corresponding to the writing polarity and the most significant bit, d3, before the scanning line 112 becomes H, and thereafter when the scanning line 112 becomes H, all of them select the other one of the first power feeding line 175 and second power feeding line 177, thus acting as a selector to apply the voltage to the node Q.

Next, the node Q is connected to one terminal of a bit capacitor 1830 in common, one terminal of a bit capacitor 1831, one terminal of a bit capacitor 1832, and the input terminal of the switch SW3. Among these, the switch (first switch) SW3 turns on when the signal $S_{set}$ is H. Further, the other terminal of the bit capacitor 1830 is connected to the input terminal of switch SW0, and the other terminal of the bit capacitor 1831 is connected to the input terminal of switch SW1, and the other terminal of the bit capacitor 1832 is connected to the input terminal of switch SW2.

Here, the signal $S_{set}$ and signal $C_{set}$ have a relationship of inverted logic levels. Also, given that the capacitor size of the bit capacitor 1830 is $C_{dac}$, the capacitor size of the bit capacitor 1831 is $2 \cdot C_{dac}$, and the capacitor size of the bit capacitor 1832 is $4 \cdot C_{dac}$. This means that the capacitor size of the bit capacitors 1830, 1831, and 1832 are 1:2:4 corresponding to the weighting of the bits, D0, D1, and D2 of the gray scale data, Data.

Each output terminal of the switches SW0, SW1, and SW2 is connected to the data line 114 of the column j in common. In this regard, each of the data lines 114 of the column j has a parasitic capacitor 1850 of the capacitor size $C_{sln}$.

Next, a description will be given of the principle of D/A conversion of the D/A converter group 180 provided with these arrangements for each column. In the D/A converter group 180, in general, an arrangement corresponding to the column j permits the charge corresponding to the most significant bit D3 to be stored in the parasitic capacitor 1850 on the data line 114 of the column j during the preset period, whereas during the set period, the arrangement permits the charges corresponding to the lower bits D0, D1, and D2 to be stored in the bit capacitors 1830, 1831, and 1832. At the same time the arrangement equalizes these charges with the charge stored in the capacitor 1850, thereby setting the voltage of the data line 114 of the column j corresponding to the gray scale data, Data.

In detail, first, when the node Q is preset to the voltage $V_s$, by turning SW3 on during the preset period in which the signal Sset becomes H, the parasitic capacitor 1850 stores the charge corresponding to the voltage $V_s$. Whereas the switches SW0, SW1, and SW2 turn on and off corresponding to the bits D0, D1, and D2. At this time, among the bit capacitors 1830, 1831, and 1832, both sides of the bit capacitor connected to the switch turned on is short-circuited, thus the charge of the bit capacitor is zero-cleared.

Second, the node Q is set to the voltage $V_c$ during the set period in which $S_{set}$ becomes L, whereas $C_{set}$ becomes H. By this, the switch SW3 turns off, and among the bit capacitors 1830, 1831, and 1832, the capacitor connected to the switch turned on stores the charge corresponding to the voltage $V_c$, but as the capacitor is connected to the data line 114, the charge stored in the capacitor and the charge stored in the parasitic capacitor 1850 of the data line 114 are equalized.

Here, given that the decimal value represented by the lower bits D0, D1, and D2 is N, the voltage applied to the data line 114 can be expressed by the following expression (1).

$$V=(N \cdot C_{dac} \cdot V_c(+)C_{sln} \cdot V_s)/(N \cdot C_{dac}(+)C_{sln}) \quad (1)$$

In the expression (1), for one liquid crystal display device, the capacitors $C_{dac}$ and $C_{sln}$ are designed as constants, while the preset voltage $V_s$ and set voltage $V_c$ can be handled as variables.

Then, when corresponding to positive polarity writing, and the most significant bit D3 is "0", the first voltage $V_{sw}((+))$ is selected as the preset voltage $V_s$, and the fourth voltage which is higher than the voltage $V_{sw}((+))$ is selected as the set voltage $V_c$. In this selection, as the characteristic $W_t((+))$ shown in FIG. 7, the voltage V increases as the decimal value N is higher starting from the voltage $V_{sw}((+))$, but the increase rate becomes smaller. In a real liquid crystal display device, this is because it will be $C_{dac}$ $C_{sln}$.

Next, when corresponding to positive polarity writing, and the most significant bit D3 is "1", the third voltage $V_{sk}((+))$ is selected as the preset voltage $V_s$, and the second voltage which is higher than the voltage $V_{sk}((+))$ is selected as the set voltage $V_c$. In this selection, as the characteristic $B_k((+))$ shown in FIG. 7, the voltage V decreases as the decimal value N is higher starting from the voltage $V_{sk}((+))$, but the decrease rate becomes smaller. Further, in the selection the voltages $V_{sk}((+))$ and $V_{ck}((+))$ is set such that when corresponding the content which bits D0, D1, and D3 of the gray scale data Data to the gray scale value, the characteristics $B_k((+))$ and $W_t((+))$ are continuous.

In the positive polarity writing, the characteristic of the voltage V against the gray scale data Data is the sum of the characteristics $W_t((+))$ and $B_k((+))$. Here, the characteristic of the voltage is emulating the gamma conversion for converting gray scale value to the voltage suited for driving the liquid crystal capacitor, thus for analog conversion, gamma conversion is executed at the same time.

Moreover, when a direct-current component is applied to liquid crystal, the component of liquid crystal changes, and as a result, so-called sticking and flickering, etc. occur and display quality is deteriorated. In the present embodiment, the voltage $LC_{com}$ applied to the counter electrode 108, which is the other terminal of liquid crystal capacitor, is constant, thus it is necessary to invert the voltage applied to the pixel electrode 118, that is, the liquid crystal capacitor based on $LC_{com}$ in a constant cycle.

When performing negative polarity writing, it is necessary to use the inverted characteristics of $W_t((+))$ and $B_k((+))$ corresponding to the positive polarity writing.

In order to have such an inversion characteristic, when corresponding to the negative polarity writing, and the most significant bit D3 is "0", a seventh voltage $V_{sw}(-)$ is selected as the preset voltage $V_s$, and a sixth voltage $V_{cw}(-)$ which is lower than $V_{sw}(-)$ is selected as the set voltage $V_c$. The characteristics of $W_t(-)$ by the selection is the inverted characteristics $W_t((+))$ corresponding to the positive polarity writing on the basis of $LC_{com}$. Here, each of $V_{sw}(-)$ and $V_{cw}(-)$ are inversion of $V_{sw}((+))$ and $V_{cw}((+))$ on the basis of $LC_{com}$. However, when taking threshold characteristic of TFT116, etc. into consideration, $LC_{com}$ is not used for the basis for inversion, but a different voltage in the neighborhood is used for the basis for inversion.

Also, when corresponding to the negative polarity writing, and the most significant bit D3 is "1", a fifth voltage $V_{sk}(-)$ is selected as the preset voltage $V_s$, and a eighth voltage $V_{ck}(-)$, which is higher than $V_{sk}(-)$ is selected as the set voltage $V_c$. The characteristics of $B_k(-)$ by the selection is inverted the characteristics $B_k((+))$ corresponding to the positive polarity writing on the basis of $LC_{com}$. Here, each of $V_{sk}(-)$ and $V_{ck}(-)$ are inversion of $V_{sk}((+))$ and $V_{ck}((+))$ on the basis of $LC_{com}$.

Figure 7:
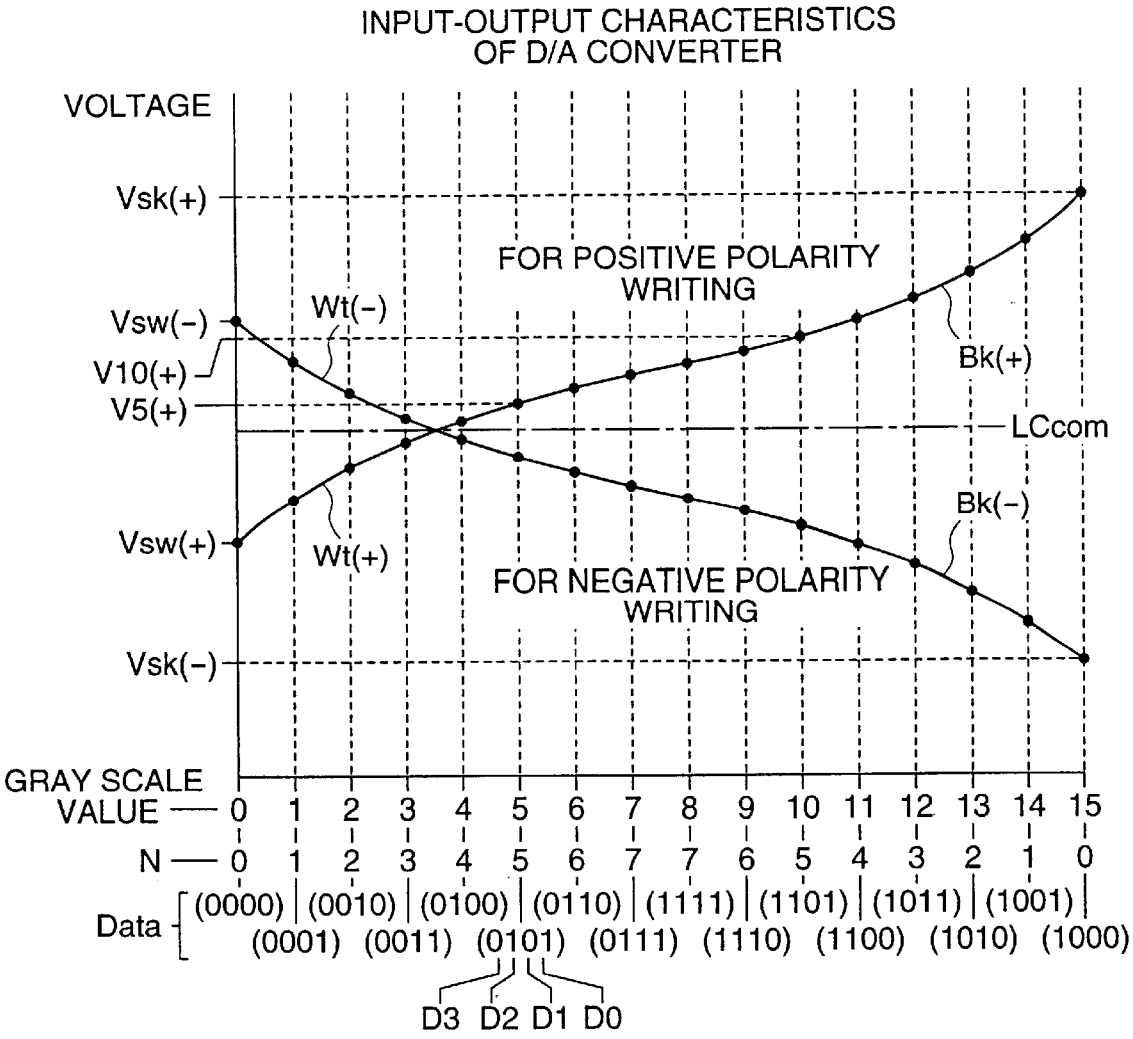
FIG. 7 is a figure showing the input-output characteristics of D/A conversion in the liquid crystal display device.

In the present embodiment like this, four pairs are provided as pairs of the preset voltage $V_s$ and set voltage $V_c$, and one of the pairs is selected corresponding to the writing polarity and the most significant bit D3, thus the D/A conversion characteristic as shown in FIG. 7 can be obtained.

Next, among the operations of the liquid crystal display device according to the structure described above, Y-side operations will be described. Here, FIG. 8 shows a timing chart illustrating the Y-side operations of the liquid crystal display device.

As shown in the figure, the shift register 130 (Refer to FIG. 2) shifts the transmission start pulse, DY, which is supplied at the start of one vertical scanning period (1F), by a rise and fall of the clock signal CLY, and at the same time, the pulse width is narrowed to be output the scanning signals Ys1, Ys2, Ys3, . . . , Ysm turns to active level (H) for every one horizontal scanning period (1H).

Here, in one vertical scanning period (1F), when the signal FLD is H, and the scanning signal $Y_S$1 turns to H, the signal PS is turned to H (positive polarity writing is directed to the pixel 120 located at the first scanning line 112), the flipflop 132 of the first row latches the signal FLD at a fall of the scanning signal $Y_S$1 thereafter.

Consequently, the selection control signal Cs1 of the flipflop of the first row turns to H by a fall of the scanning signal Ys1 (this means that TFT116 of the pixel located on the first row), the selector 134 of the first row selects the input terminal A, thus the capacitor swing signal Yc1 supplied to the capacitor line 113 of the first row will be at the high capacitor voltage $V_{st}((+))$.

Specifically, when the scanning signal Ys1 turns to L after the scanning signal Ys1 becomes H to direct the positive polarity writing, the capacitor swing signal Yc1 turns to the capacitor voltage $V_{st}((+))$.

Next, when the scanning signal Ys2 becomes H, the signal PS turns to L (negative polarity writing is directed to the electrode 120 located at the second scanning line 112). After this, the fliflop of the second row latches the signal FLD at a fall of the scanning signal Ys2, thus the selection control signal Cs2 turns to H when the scanning signal Ys2 falls (This means when TFT116 of pixel 120 located on the second row goes off), thereby the selector 134 of the second row selects the input terminal A.

However, the selector of even number and the selector of odd number have the opposite capacitor voltage supplied to their input terminals A and B each other (Refer to FIG. 2), the capacitor swing signal Yc2 supplied to the second capacitor line 113 turns to low-side of the capacitor voltage $V_{st}(-)$ at a rise of the scanning signal Ys2.

Specifically, when the scanning signal Ys2 turns to L after the scanning signal Ys2 becomes H to direct the negative polarity writing, the capacitor swing signal Yc2 turns to the capacitor voltage $V_{st}(-)$.

The same operation will repeat for the flipflops 132 and selectors 134 of the third, fourth, fifth, and the row m. Specifically, in one vertical scanning period (1F) in which the signal FLD is H, when the scanning signal Ysi supplied to the scanning line 112 of the row i becomes H, if i is an even number, positive polarity writing is directed, and thereafter when the scanning signal Ysi turns to L, the capacitor swing signal Yci supplied to the capacitor line 113 of the row i turns from the low capacitor voltage $V_{st}(-)$ to high capacitor voltage $V_{st}((+))$, whereas if i is an odd number, negative polarity writing is directed, and thereafter when the scanning signal Ysi turns to L, the capacitor swing signal Yci turns from the high capacitor voltage $V_{st}((+))$ to low capacitor voltage $V_{st}(-)$.

Moreover, in the next vertical scanning period, the signal FLD becomes L. Thus, when the scanning signal Ysi supplied to the capacitor line 112 turns from H to L, the capacitor swing signal Yci supplied to the capacitor line 113 of the row i turns from the high capacitor voltage $V_{st}((+))$ to low capacitor voltage $V_{st}(-)$ if i is an odd number, and it turns from the low capacitor voltage $V_{st}(-)$ to high capacitor voltage $V_{st}((+))$ if i is an even number.

However, the logic level of the signal PS is also inverted, thus when the scanning signal Ysi turns to L after directed for the positive polarity writing, the capacitor swing signal Yci turns from the low capacitor voltage $V_{st}(-)$ to high capacitor voltage $V_{st}((+))$, whereas when the scanning signal Ysi turns to L after directed for the negative polarity writing, the capacitor swing signal Yci turns from the high capacitor voltage $V_{st}((+))$ to low capacitor voltage $V_{st}(-)$.

Next, among the operations of the liquid crystal display device, X-side operations will be described. Here, FIGS. 9 and 10 show timing charts illustrating the X-side operations of the liquid crystal display device.

First, in the FIG. 9, when paying attention to one horizontal scanning period including the period in which the scanning signal Ys1 of the first row becomes H, before the one horizontal scanning period, the gray scale data, Data, corresponding to the pixels of the first row and first column, the first row and second column, . . . ,first row and the column n are supplied in sequence. Among these, at the timing when gray scale data, Data, corresponding to the pixel of the first row and first column, when the sampling control signal Xs1, which is output from the shift register 150, becomes H, the first sampling switch 152 corresponding to the first column is turned on, thereby the gray scale data is latched by the first latch circuit 1802 corresponding to the same first column.

Next, at the timing when gray scale data, Data, corresponding to the pixel of the first row and second column, when the sampling control signal Xs2 becomes H, the first sampling switch 152 corresponding to the second column is turned on. Thereby, the gray scale data is latched by the first latch circuit 1802 corresponding to the same second column, as in the same manner, gray scale data, Data, corresponding to the pixel of the first row and the column n is latched by the first latch circuit 1802 corresponding to the column n. Consequently, the gray scale data, Data, corresponding to the pixels of the number n located at the first row are latched respectively by the first latch circuits corresponding to the first column, second column, . . . , the column n.

Then, when the latch pulse LAT is output (when the logic level turns to H), the gray scale data, Data, latched respectively to the first latch circuits 1802 corresponding to each column is latched all at once respectively to the second latch circuits 1806 corresponding to the column when the second sampling switch 1804 is turned on.

The gray scale data, Data, latched respectively by the second latch circuit 1806 corresponding to the first column, second column, . . . , the column n is converted into the analog signal of the polarity corresponding to the logical of the signal PS by the D/A conversion respectively corresponding to the column, and is output as the data signals S1, S2, . . . ,Sn.

Here, in one horizontal scanning period in which the signal PS is H (1H), the D/A conversion operation of the D/A converter group 180 will be described. In this regard, the D/A conversion operations are performed all at once from the first column to the column n, but for the sake of convenience, the operation of the column j will be described.

At the beginning, in the FIG. 10, attention will be given to one horizontal scanning period in which the signal PS is H (the period shown by in FIG. 10, this period corresponds to the period in FIG. 9).

First, in the first preset period in one horizontal scanning period, the signal $C_{set}$ becomes L. Consequently, the signal $C_{set1}$ becomes H in response to (in accordance with) the decoding by the decoder 160, and the signal $\overline{C}_{set1}$ becomes L by the inversion of the inverter 162. Accordingly, the switch 1814 turns on, and the switch 1816 turns off in FIG. 6.

Further, the gray scale signal $V_{dac}$1 supplied to the first power feeding line 175 is set to $V_{sw}((+))$ in response to (in accordance with) the decoding by decoder 172, and the gray scale signal $V_{dac}$2 supplied to the second power feeding line 177 is set to $V_{sk}((+))$ in response to (in accordance with) the decoding by decoder 174.

Also, as described above, the signal $S_{set}$ and the signal $C_{set}$ have the relationship that the logic level is inverted each other, thus when the signal $C_{set}$ becomes L, the signal $S_{set}$ turns to H. Consequently, in FIG. 6, the switch SW3 is turned on in the preset period. Moreover, the second latch circuit 1806 latches each bits D0, D1, D2, and D3 of the gray scale data Data, thus the switches SW0, SW1, and SW2 are turned on and off according to these latch results. For example, the bit D0 of the gray scale data is "1", the bit D1 is "0", and the bit D2 is "1", then the switches SW0 and SW2 are turned on, and SW1 is turned off.

Further, given that the bit D3 is "0", the node P turns to L corresponding to the "0" of the bit D3 when the switch 1814 is turned on. Consequently, the switch 1824 turns on, and the switch 1826 turns off, thus the node Q will be at the voltage $V_{sw}((+))$ of the gray scale signal $V_{dac}$1.

Figure 11:
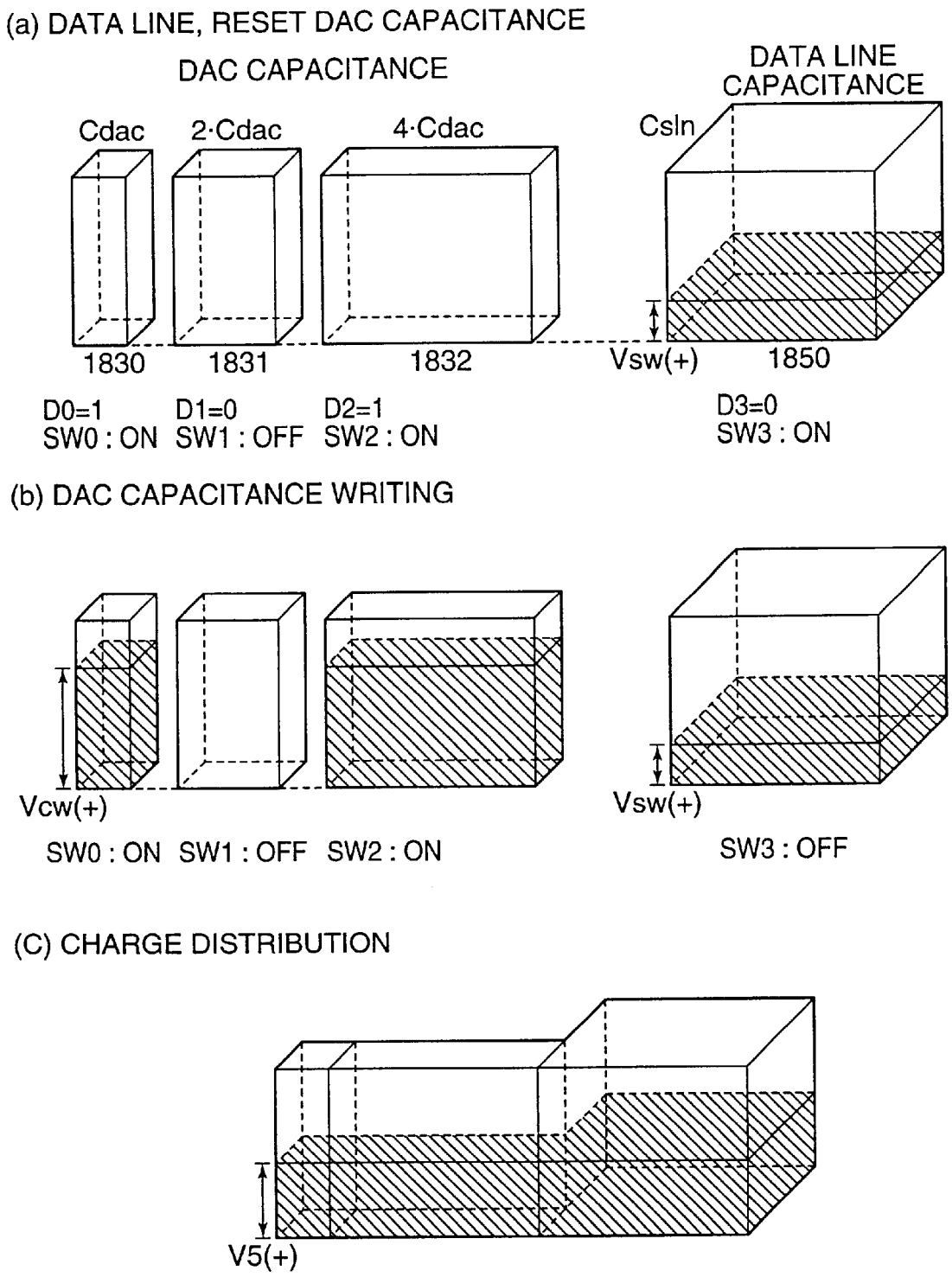
FIGS. 11(*a*), 11(*b*), and 11(*c*) each illustrate the operations of D/A conversion in the liquid crystal display device.

Accordingly, as shown in FIG. 11(*a*), a parasitic capacitor 1850 of the data line 114 stores charge corresponding the voltage $V_{sw}((+))$ when the switch SW3 turns on. Moreover, the charge contained in the bit capacitor 1830 of which both terminals are short-circuited by turning on the switch SW3 is zero cleared.

Next, in FIG. 10, in the period in which the signal PS is H, in the set period when the signal $C_{set}$ becomes H, the signal $C_{set}$1 turns to L, and the signal $C_{set}$1 turns to H. Consequently, in FIG. 6, the switch 1814 turns off, and the switch 1816 turns on, thus on-off relationship is switched, thus the node P becomes H, which is the inversion result of the inverter 1812.

Moreover, a gray scale signal $V_{dac}$1 supplied to the first power feeding line 175 is decoded to $V_{ck}((+))$ by a decoder 172, and a gray scale signal $V_{dac}$2 supplied to the second power feeding line 177 is decoded to $V_{cw}((+))$ by a decoder 174. Here, the node P becomes H, thus on and off relationship of the switches 1824 and 1826 is switched, thereby turning the node Q to $V_{cw}((+))$, which is the voltage of the gray scale signal $Vdac^2$.

Additionally, as shown in FIG. 10, when the signal $C_{set}$ becomes H, the signal $S_{set}$ turns to L, thereby turning the switch SW3 off.

As a result, as shown in FIG. 11(*b*), each of the bit capacitors 1830 and 1832 stores the charge corresponding to the voltage $V_{cw}((+))$.

However, the switches SW0 and SW1 stay on, thus as shown in FIG. 11(*c*), the charge is passed from the bit capacitors 1830 and 1832 to the parasitic capacitor 1850. Then when the potential difference disappears, transferring charge is completed, thus the charging voltage (the voltage of data line) is steadily positive polarity writing, and becomes the voltage V5((+)) corresponding to the gray scale data Data (0101) (Refer to FIGS. 7 and 11(*c*)).

Figure 12:
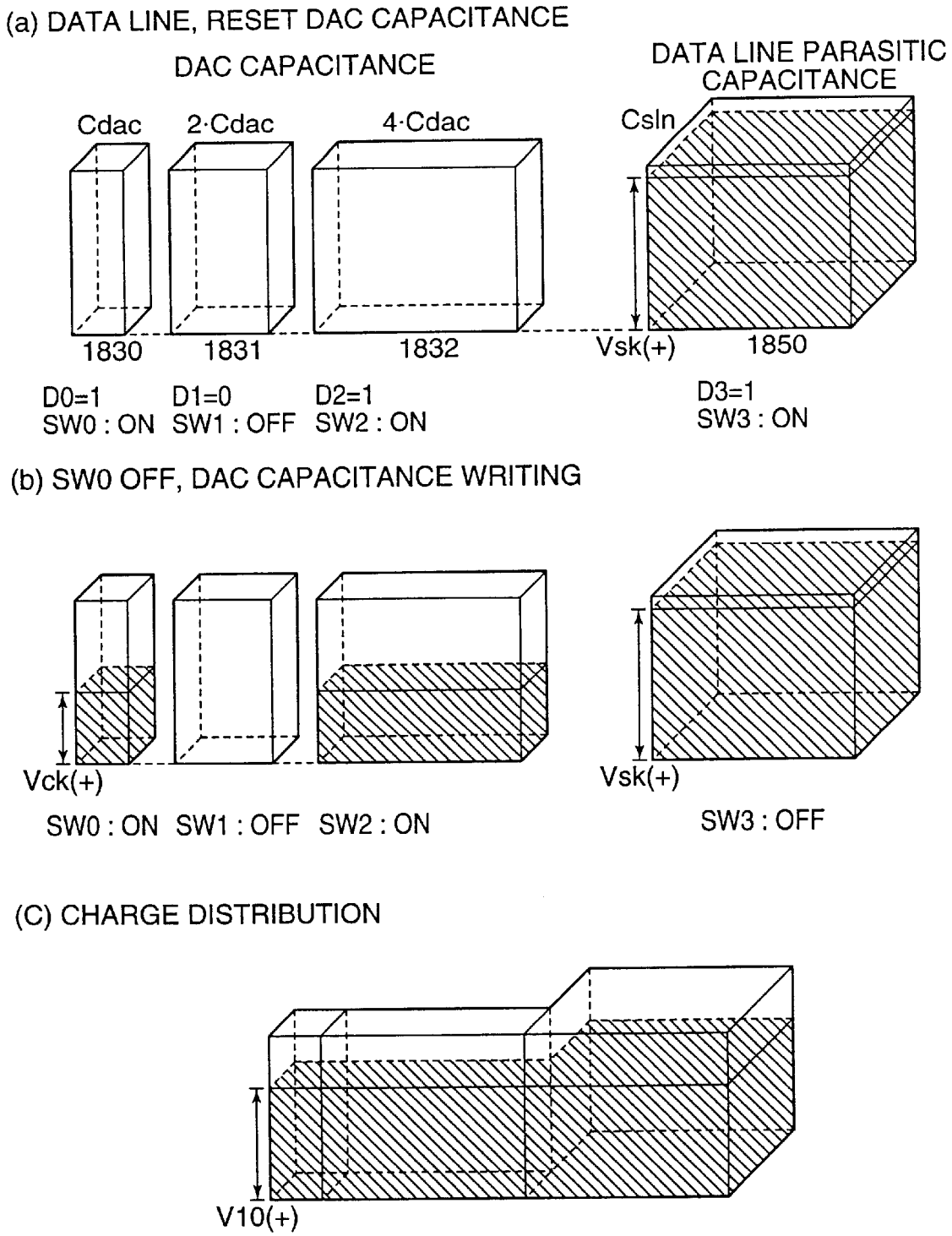
FIGS. 12(*a*), 12(*b*), and 12(*c*) each illustrate the operations of D/A conversion in the liquid crystal display device.

In this regard, within the period when the signal PS is H, in the preset period when the signal $C_{set}$ is L, if the bit D3 is "1", the node P becomes H, thus the switch 1824 turns on, as a result, the node Q will be at $V_{sk}((+))$, which is the voltage of the gray scale signal $V_{dac}$2. Consequently, as shown in FIG. 12(*a*), the parasitic capacitor 1850 stores the charge corresponding to $V_{sk}((+))$.

Then, in the set period when signal $C_{set}$ is H, the node P becomes L, thus the switch 1826 turns on, as a result, the node Q will be at $V_{ck}((+))$, which is the voltage of the gray scale signal $V_{dac}$1. As a result, as shown in FIG. 12(*b*), each of the bit capacitors 1830 and 1832 stores the charge corresponding to the voltage $V_{ck}((+))$, and at the same time, as shown in FIG. 12(*c*), the charge is passed from the parasitic capacitor 1850 to the bit capacitors 1830 and 1832. Then when the potential difference disappears, transferring charge is completed, thus the voltage of data line is steadily positive polarity writing, and becomes the voltage V10((+)) corresponding to the gray scale data Data (1101) (Refer to FIGS. 7 and 12(*c*)).

After all, within one horizontal scanning period in which the signal PS becomes H, in the preset period in which the signal $C_{set}$ is L, if the bit D3 is "0", the data signal Sj is set to the voltage $V_{sw}((+))$, and if the bit D3 is "1", the data signal Sj is set to the voltage $V_{sk}((+))$. After this, in the set period in which the signal $C_{set}$ is H, the data signal corresponds to the gray scale data, Data, and positive-polarity writing within the range from $V_{sw}((+))$ to $V_{sk}((+))$.

Then, the scanning signal Ys1 which is supplied to a first scanning line 112 becomes H in the set period. Accordingly, at the pixel 120 of the first row, the data signal S1, S2, . . . , Sn of the voltage corresponding to the positive polarity writing are applied at all columns to the pixel electrode 118 by turning on TFT116.

Next, when paying attention to one horizontal scanning period including the period in which the second scanning signal Ys2 becomes H (the period shown in FIGS. 9 and 10), before one horizontal scanning period, the gray scale data, Data, corresponding to the pixels of the second row and first column, the second row and second column, and second row and nth column is supplied in sequence, and similar operation is executed as the previous horizontal scanning period.

Specifically, first, when the sampling control signal Xs1, Xs2, . . . , Xsn becomes H in sequence, the gray scale data Data corresponding to pixels of the second row and first column, the second row and second column, and second row and nth column is latched in the first latch circuit 1802. Second, the latched gray scale data is latched to the corresponding columns of the second latch circuit 1806 all at once by the latch pulse LAT. Third, data signals S1, S2, . . . , Sn which have been analog-converted corresponding to the latch result is output.

However, in the horizontal scanning period, the signal PS is L, thus the signal $C_{set}$1 becomes L during the preset period when the signal $C_{set}$ is L. The signal $C_{set}$1 becomes H by the inversion of the inverter 162. Accordingly, the switch 1814 turns off, and the switch 1816 turns on.

Further, the gray scale signal $V_{dac}$1 supplied to the first power feeding line 175 is set to $V_{sk}(-)$ in accordance with the decoding by decoder 172, and the gray scale signal $V_{dac}$2 supplied to the second power feeding line 177 is set to $V_{sw}(-)$ in accordance with the decoding by decoder 174.

Accordingly, within one horizontal scanning period when the signal PS is H, in the preset period when the signal $C_{set}$ is L, if the bit D3 is "0", the node P becomes H, thus the switch 1824 turns on, and the switch 1826 turns off, and the signal $S_{set}$ becomes H, thereby turning the switch SW3 on.

As a result, charging voltage to the parasitic capacitor 1850 is performed by the voltage $V_{sw}(-)$ of the gray scale signal $V_{dac}$2, Moreover, if the bit D3 is "1", the node P becomes L, thus the switch 1824 turns off, and the switch 1826 turns on, and the signal $S_{set}$ becomes H, thereby turning the switch SW3 on. As a result, charging voltage to the parasitic capacitor 1850 is performed by the voltage $V_{sk}(-)$ of the gray scale signal $V_{dac1}$.

After this, during the set period when the signal $C_{set}$ is H, and the signal $C_{set}$1 becomes L, thus the switch 1814 turns on, and the switch 1816 turns off. Also, during the period when the signal $C_{set}$ is H, the signal $S_{set}$ becomes L, thereby turning the switch SW3 off.

Further, the gray scale signal $V_{dac}$1 supplied to the first power feeding line 175 becomes $V_{cw}(-)$, and the gray scale signal $V_{dac}$2 supplied to the second power feeding line 177 becomes $V_{ck}(-)$.

Accordingly, within one horizontal scanning period when the signal PS is L, in the set period when the signal $C_{set}$ is H, if the bit D3 is "0", the node P becomes L, thus the switch 1824 turns off, and the switch 1826 turns on. As a result, the node Q will be at the voltage $V_{cw}(-)$ of the gray scale signal $V_{dac1}$.

Consequently, among the bits 1830, 1831, and 1832, if the corresponding bit is "1", the charge corresponding to the voltage $V_{cw}(-)$ is stored, at the same time, for the parasitic capacitor 1850, the charge is equalized with the charge stored corresponding to the voltage $V_{sk}(-)$.

Moreover, within one horizontal scanning period when the signal PS is H, in the set period when the signal $C_{set}$ is H, if the bit D3 is "1", the node P becomes H, thus the switch 1824 turns on, and the switch 1826 turns off, and the node Q will be at the voltage $V_{ck}(-)$ of the gray scale signal $V_{dac}$2.

Consequently, among the bits 1830, 1831, and 1832, if the corresponding bit is "1", the charge corresponding to the voltage $V_{ck}(-)$ is stored, at the same time, for the parasitic capacitor 1850, the charge is equalized with the charge stored corresponding to the voltage $V_{ck}(-)$.

After all, within one horizontal scanning period in which the signal PS becomes L, in the preset period in which the signal $C_{set}$ is L, if the bit D3 is "0", the data signal Sj is set to the voltage $V_{sw}(-)$, and if the bit D3 is "1", the data signal Sj is set to the voltage $V_{sk}(-)$. After this, in the set period in which the signal $C_{set}$ is H, the data signal Sj corresponds to the gray scale data Data, and negative-polarity writing within the range from $V_{sw}(-)$ to $V_{sk}(-)$.

Then, the scanning signal Ys2 which is supplied to a second scanning line 112 becomes H in the set period when the signal $C_{set}$ becomes H, thus at the pixel 120 of the second row, the data signal S1, S2, . . . , Sn of the voltage corresponding to the negative polarity writing are applied in all columns to the pixel electrode 118 by turning on TFT116.

After this, the same operations are repeated for every one horizontal scanning period. Specifically, before one horizontal scanning period when the scanning signal Ysi supplied to the scanning line 112 of the row i becomes H, the gray scale data Data corresponding to the pixels of the ith row and first column, the ith row and second column, and ith row and nth column is supplied in sequence, and latched in the first latch circuit 1802 corresponding to the first row, second row, . . . , and nth row. Then, the latched gray scale data is latched to the corresponding columns of the second latch circuit 1804 all at once by the latch pulse LAT, and D/A-converted corresponding to the column to be output as analog signal of the polarity corresponding to the logical level of PS, thereby being output as the data signals S1, S2, . . . , Sn.

At this time, the voltages of the data signals S1, S2, . . . , Sn correspond to positive polarity writing if i is an odd number, that is, the signal PS is H, whereas the voltages correspond to negative polarity writing if i is an even number, that is, the signal PS is L.

In this regard, in the next vertical scanning period, the similar operations are performed, and within the same horizontal scanning period, the signal PS is inverted for every one vertical scanning period, thus the data signals S1, S2, . . . , Sn correspond to negative polarity writing if i is an even number, whereas the data signals correspond to positive polarity writing if i is an odd number.

Next, a description will be given of the operations of the storage capacitor and liquid crystal capacitor when the above-described operations of X-side and Y-side are performed. Each of FIGS. 13(*a*), 13(*b*), and 13(*c*) include figures to illustrate storage operations of the charge of these capacitors.

In this regard, two measures in these figures represent a storage capacitor and a liquid crystal capacitor, respectively. For details, the areas of the bases represent the sizes of the storage capacitor $C_{stg}$ (119) and liquid crystal capacitor $C_{Lc}$, respectively, the water contained in the measures represent the charge, and its height represent the voltage.

Figure 13:
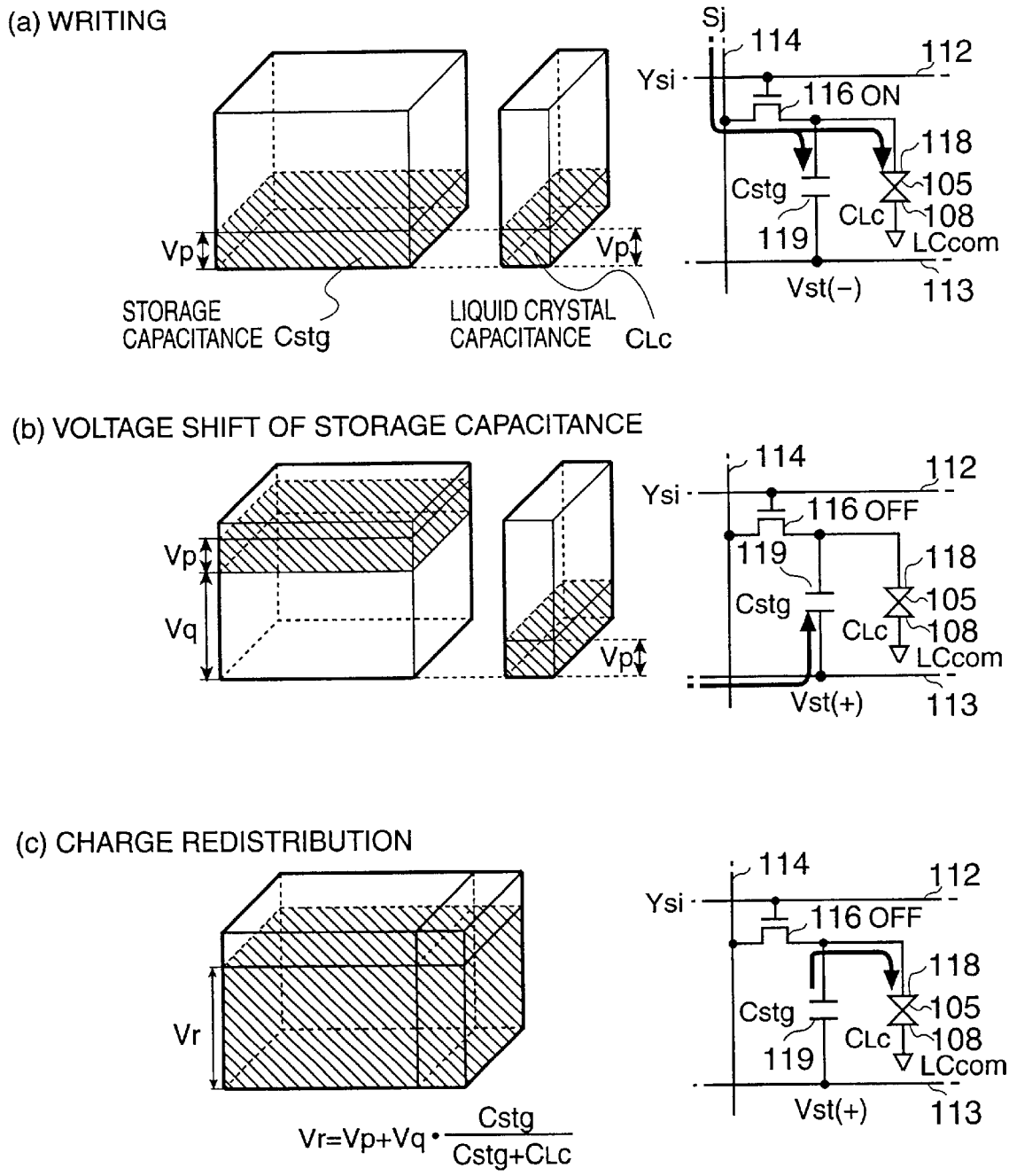
FIGS. 13(*a*), 13(*b*), and 13(*c*) each illustrate the operations of pixel in the liquid crystal display device.

Here, for the sake of explanation, a description is given of the case of performing positive-polarity writing at the pixel 120 with location of the row i and the column j. First, when the scanning signal Ysi becomes H, the TFT 116 of the pixel turns on, thus, as shown in FIG. 13(*a*), the storage capacitor $C_{stg}$ and liquid crystal capacitor $C_{Lc}$ store the charge corresponding to the voltage of the data line Sj. Given that the writing voltage to the storage capacitor $C_{stg}$ and liquid crystal capacitor $C_{Lc}$ is Vp.

Next, when the scanning signal Ysi becomes L, the TFT 116 of the pixel turns off, and in the case of positive-polarity writing, the capacitor swing signal Yci turns from the low-side capacitor voltage $V_{st}(-)$ to the high-side capacitor voltage $V_{st}((+))$ as described above. Accordingly, as shown in FIG. 13(*b*), the charging voltage of the storage capacitor $C_{stg}$ is raised by the transition component Vq. Here $Vq=\{V_{st}((+))-V_{st}(-)\}$.

However, since one terminal of the storage capacitor $C_{stg}$ is connected to the pixel electrode 118, as shown in FIG. 13(*c*), the charge is transferred from the storage capacitor $C_{stg}$ of which voltage was raised to the liquid crystal capacitor $C_{Lc}$. When there is no voltage difference between both of the capacitors, transferring the charge is completed, thus the charging voltages of both capacitors finally become the voltage Vr. The voltage Vr continues to be applied to the liquid crystal capacitor $C_{stg}$ almost all the period when TFT116 is off, thus the voltage Vc can be assumed to be applied to the liquid crystal capacitor $C_{Lc}$ effectively from the time when TFT116 is on.

The voltage Vr can be expressed by the following expression (2) using the storage capacitor $C_{stg}$ and the liquid crystal capacitor $C_{Lc}$.

$$Vr=Vp(+)Vq\cdot C_{stg}/(C_{stg}(+)C_{Lc}) \quad (2)$$

Here, if the storage capacitor $C_{stg}$ is by far larger than the liquid crystal capacitor $C_{Lc}$, the expression (2) can be approximated by the expression (3).

$$Vr=Vp(+)Vq \quad (3)$$

Specifically, final charging voltage of the liquid crystal capacitor $C_{Lc}$, that is, Vr is simplified as the initial writing voltage, Vp shifted high-side as much as Vq, that is, the raised amount of the capacitor swing signal Yci.

In this regard, here, the operations as shown in FIGS. 13(*b*) and 13(*c*) are explained separately for the sake of simplification, but in practice, it should be understood that both operations can occur concurrently. Also, a description is given of the case where positive-polarity writing is performed, however, in the case of negative-polarity writing, if the storage capacitor $C_{stg}$ is by far larger than the liquid crystal capacitor $C_{Lc}$, the final voltage applied to the liquid crystal capacitor $C_{Lc}$, that is, Vr is the initial writing voltage, Vp, shifted low-side as much as Vp, that is, the raised amount of the capacitor swing signal Yci.

Figure 14:
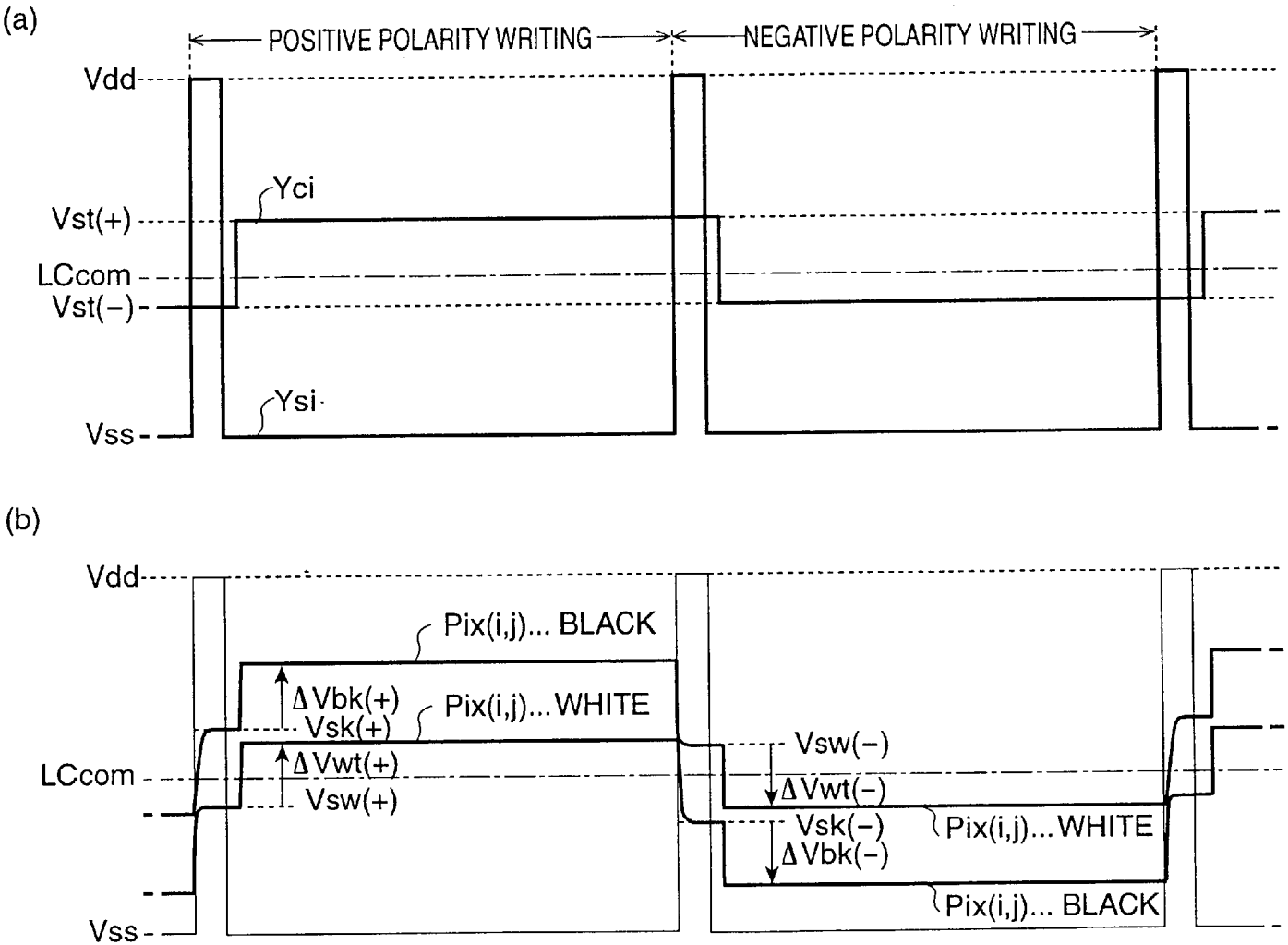
FIG. 14(*a*) shows voltage waveforms of a scanning signal and a capacitor swing signal in the liquid crystal display device.

Specifically, the voltage Pix (i, j) applied to the pixel electrode 118 of the pixel 120 with i rows and j columns becomes, as shown in FIG. 14(*b*), first the voltage of the data signal Sj supplied to the data line 114 of the column j once when TFT116 is on, and second, immediately after TFT116 is off, if it is a positive-polarity writing, the capacitor swing signal Yci changes from low-side capacitor voltage $V_{st}(-)$ to the high-side capacitor voltage $V_{st}((+))$, thereby shifts to the high-side, whereas if it is a negative-polarity writing, the capacitor swing signal Yci becomes from high-side capacitor voltage $V_{st}((+))$ to the low-side capacitor voltage $V_{st}(-)$, thereby shifts to the low-side.

In practice, the storage capacitor $C_{stg}$ cannot become by far larger than the liquid crystal capacitor $C_{Lc}$, and capacitor size of the liquid crystal capacitor $C_{Lc}$ has a characteristic that it changes according to the charging voltage. As a result, Pix (i, j) is, for example, the voltage $V_{sw}((+))$ corresponding to white level of positive-polarity writing when TFT116 is on, after TFT116 is off, the voltage does not shift to high level in accordance with the increase amount of the capacitor voltage, but shifts to high level as much as ΔVwt((+)) depending on the voltage Vsw((+)) and the capacitance ratio, that is the storage capacitor $C_{stg}$ over the liquid crystal capacitor $C_{Lc}$.

In this regard, FIG. 14(*b*) shows separately that, first, if Pix (i, j) is Vsk((+)) which is corresponding to a black level of positive-polarity writing when TFT116 is on, the voltage is shifted by ΔVbk((+)) to high level depending on the increase amount of capacitor voltage, the voltage Vsk((+)), capacitance ratio after TFT116 is off. Secondly, if Pix (i, j) is Vsw(−) which is corresponding to a white level of negative-polarity writing when TFT116 is on, the voltage is shifted by ΔVwt(−) to low level depending on the decrease amount of capacitor voltage, the voltage Vsw(−), capacitance ratio after TFT116 is off, and third, if Pix (i, j) is Vsk(−) which is corresponding to a black level of negative-polarity writing when TFT116 is on, the voltage is shifted by ΔVbk(−) to high level depending on the decrease amount of capacitor voltage, the voltage Vsk(−), capacitance ratio after TFT116 is off.

As described above, according to the present embodiment, the voltage of the pixel electrode 118 changes no less than the swing voltage of the data signals S1, S2, S3, . . . , and Sn supplied to the data line 114. Specifically, according to the present embodiment, even if the swing voltage range is small, the effective voltage applied to the liquid crystal capacitor is enlarged more than the range. As a result, a level shifter which has been provided at the final stage in order to enlarge the voltage of the data signal conventionally becomes unnecessary, thus free space increases in circuit layout for that amount, and further making it possible to reduce wasted power which increase as the voltage increase can be reduced. In addition, all the circuits from X-side shift register 150 to D/A converter group 180 can be driven by low voltage, thus making it possible to make the elements (TFT) constituting these circuits small. Accordingly, it is possible to make the pitch of the data line 114 narrower, thereby making it easier to achieve high-definition in a display.

Further, in the present embodiment, the other terminal of the storage capacitor $C_{stg}$ is connected to the scanning line 112, and there are following advantages over the methods of driving scanning lines with multiple values (for example, refer to the techniques disclosed in Japanese Unexamined Patent application Publication Nos. 2-913 and 4-145490).

Specifically, in the method of driving scanning lines with multiple values, as additional storage capacitor is connected to the scanning line, load becomes larger. However, in general, the swing voltage of the scanning signal supplied to a scanning line is greater than the swing voltage of the data signal supplied to the data line (refer to FIG. 14(*a*)). Accordingly, in the method of driving scanning lines with multiple values, high swing voltage is applied to the scanning line appended the load, thus more power is consumed, thereby making it difficult to reduce power consumption.

On the contrary, in a present embodiment, the other terminal of the storage capacitor $C_{stg}$ (119) is raised or lowered by the capacitor swing signal supplied to the capacitor line 113. Therefore, the effective voltage applied to the liquid crystal capacitor is enlarged, the capacitor appended to the scanning line is not changed, and the smaller the swing voltage of the data signal is kept, the smaller can be the swing voltage of the scanning signal, thereby making it possible to reduce power consumption.

Also, in the present embodiment, there are the following advantages over the method of shifting (raising or lowering) the voltage of the counter electrode for each certain period (for example, one horizontal scanning period). Specifically, if the voltage of the counter electrode is shifted, all the parasitic capacitors of the counter electrode are affected all at once, thus power consumption cannot be reduced as intended.

On the contrary, in the present embodiment, the voltage of the capacitor line 113 shifts only for every horizontal scanning period in sequence. Accordingly, within one horizontal scanning period, only the parasitic capacitor of one capacitor line 113 is affected. As a result, according to the present embodiment, the capacitor affected by the shifting of the voltage is by far less than that of the method in which the counter electrode is shifted, thereby the present embodiment is more advantageous than the other methods.

In addition, in the present embodiment, the swing voltage of the data signals S1, S2, S3, . . . , and Sn is kept small, thus a maximum and a minimum swing of eight voltages necessary for D/A conversion is also kept small, thereby making it possible to reduce load of the power supply circuit which generates these voltages.

In the present embodiment, at the time of D/A conversion corresponding to positive-polarity writing, in order to store charge into each capacitor, when the upper bit D3 is "0", the voltage needs to be changed from $V_{sw}((+))$ to $V_{cw}((+))$, and when the upper bit D3 is "1", the voltage needs to be changed from $V_{sk}((+))$ to $V_{ck}((+))$, respectively. Also, at the time of D/A conversion corresponding to negative-polarity writing, in order to store charge into each capacitor, when the upper bit D3 is "0", the voltage needs to be changed from $V_{sw}(-)$ to $V_{cw}(-)$, and when the upper bit D3 is "1", the voltage needs to be changed from $V_{sk}(-)$ to $V_{ck}(-)$, respectively.

Consequently, for simplicity, an arrangement can be made in which the voltages Vsw((+)), Vcw((+)), Vsw(−), and Vcw(−) are supplied to one power feeding line in sequence, and the voltages Vsk((+)), Vck((+)), Vsk(−), and Vck(−) are supplied to the other power feeding line in sequence, and either of the lines is selected depending on the writing polarity and the upper bit D3. However, in this arrangement, the voltage change of each power feeding line is large, thus the power is consumed worthlessly by the parasitic capacitor on the power feeding line.

Figure 18:
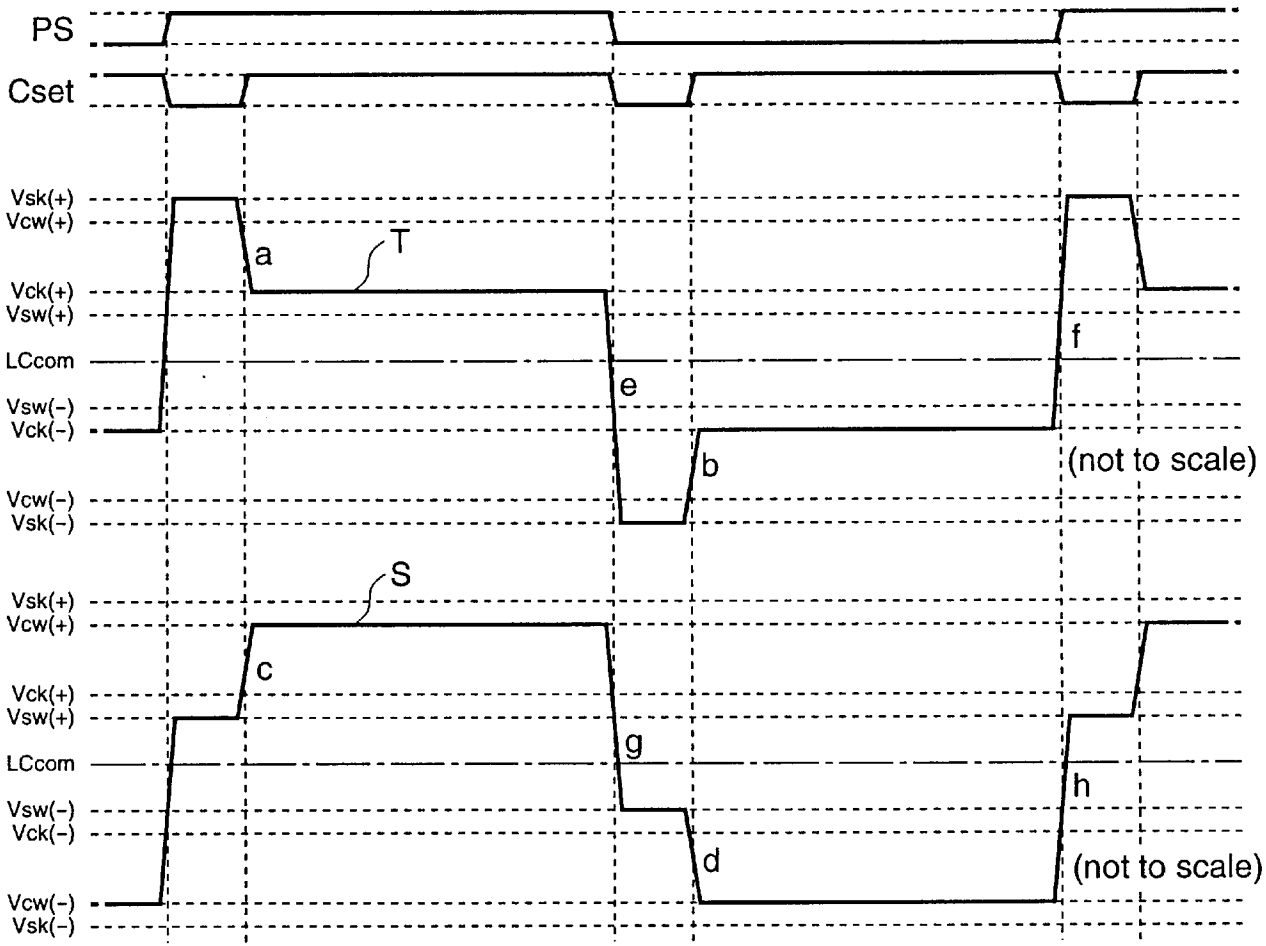
FIG. 18 shows, in comparison with the present embodiment, the voltage transition in the case where the voltage at the other end of the storage capacitance is not shifted, and the voltage is not switched.

In particular, for example, when the other terminal of the storage capacitor 119 is not shifted, if the voltages Vsw((+)), Vcw((+)), Vsw(−), and Vcw(−) are supplied to one power feeding line in sequence, the voltage has a waveform as shown by S in FIG. 18, and if the voltages Vsk((+)), Vck((+)), Vsk(−), and Vck(−) are supplied to the other one line in sequence, the voltage has a waveform as shown by T in FIG. 18.

Figure 19:
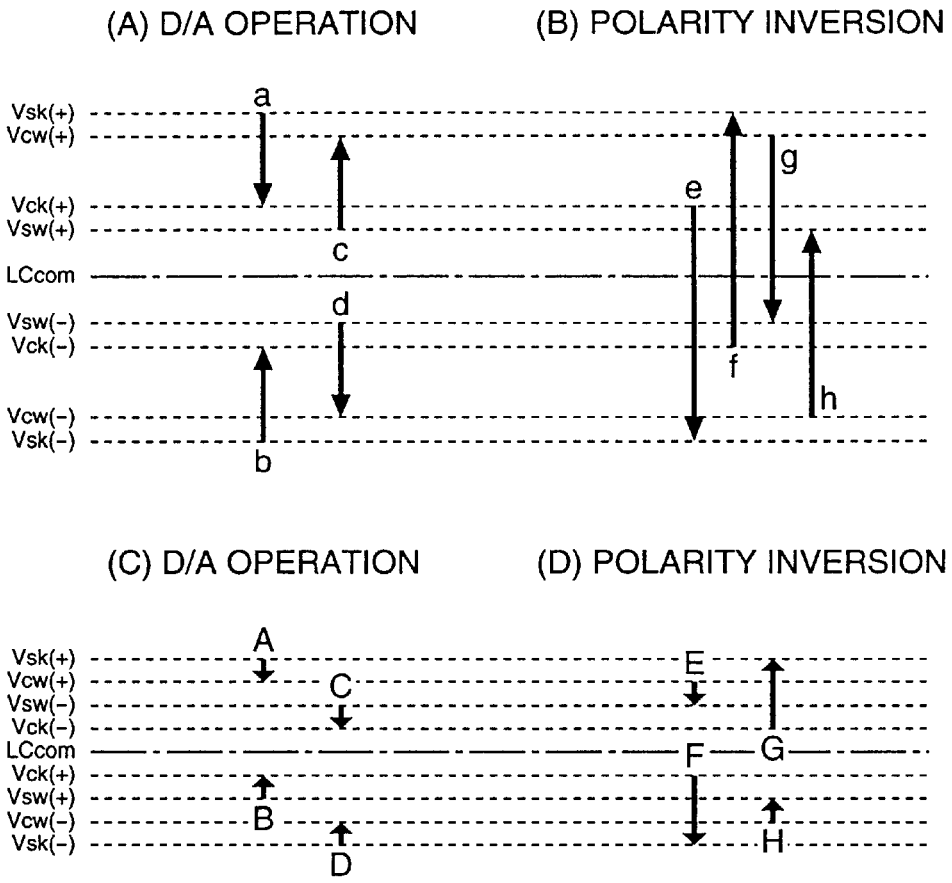
FIGS. 19(*a*), 19(*b*), 19(*c*), and 19(*d*) show voltage transitions.

Here, the voltage waveform S has a large voltage change at the time of D/A conversion (at the time when the signal $C_{set}$ becomes H, or at the time when $S_{set}$ becomes L, that is, at the time of change from the preset period to the set period) as shown by c and d in FIG. 18 or FIG. 19(A), and at the time of polarity inversion (at the time when the signal PS becomes H or L), as shown by e and f in FIG. 18 or FIG. 19(B). In a similar fashion, a voltage change in the voltage waveform T becomes larger at a D/A conversion as indicated by a and b in FIG. 18 or 19 and at a polarity inversion as indicated by e and f in FIG. 18 or 19.

On the contrary, in the present embodiment, arrangement is made such that at the time of D/A conversion and polarity conversion, the power feeding is switched from one to the other one of the first power feeding line 175 and the second power feeding line 177 by the inverters 1812, 1822, and the switches 1814, 1816, 1824, and 1826, thereby making the power changes on both power feeding lines small.

In detail, in the present embodiment, the voltage change is kept small for the voltage waveform of the gray scale signal Vdac1 supplied to the first power feeding line 175 at the time of D/A conversion as shown by B and D in FIG. 10 or FIG. 19(C), and at the time of polarity inversion as shown by F and H in FIG. 10 or FIG. 19(D). Similarly, the voltage change is kept small for the voltage waveform of the gray scale signal Vdac2 supplied to the second power feeding line 177 at the time of D/A conversion as shown by A and C in FIG. 10 or FIG. 19(C), and at the time of polarity inversion as shown by E and G in FIG. 10 or FIG. 19(D).

As a result, according to the present embodiment, together with the arrangement to keep maximum and minimum swing voltages of the eight voltages necessary at the time of D/A conversion small, the arrangement of switching power supply from one to the other one of the first power feeding line 175 and the second power feeding line 177, the voltage changes of the first power feeding line 175 and the second power feeding line 177 are kept small. Accordingly, the power consumed by the parasitic capacitor on these power feeding lines is kept at the minimum, thereby making it possible to further reduce power consumption.

As described above, if the storage capacitor $C_{stg}$ is by far larger than the liquid crystal capacitor $C_{Lc}$, the final charging voltage of the liquid crystal capacitor $C_{Lc}$, that is, Vr can be handled as the initial writing voltage, Vp shifted high-side or low-side as much as the voltage shift amount of the capacitor swing signal Yci (the voltage shift amount at the other terminal of the storage capacitor).

However, in practice, due to restrictions of layout of circuit element and wiring and so on, there is a limit that the storage capacitor is about severalfold amount of the liquid crystal capacitor practically, thus the voltage shift amount (raised amount or lowered amount) of the capacitor swing signal Yci does not become the voltage shift amount of the pixel electrode. Specifically, the voltage shift amount of the capacitor swing signal Yci is compressed and reflected as the voltage shift amount of the pixel electrode 118.

Figure 15:
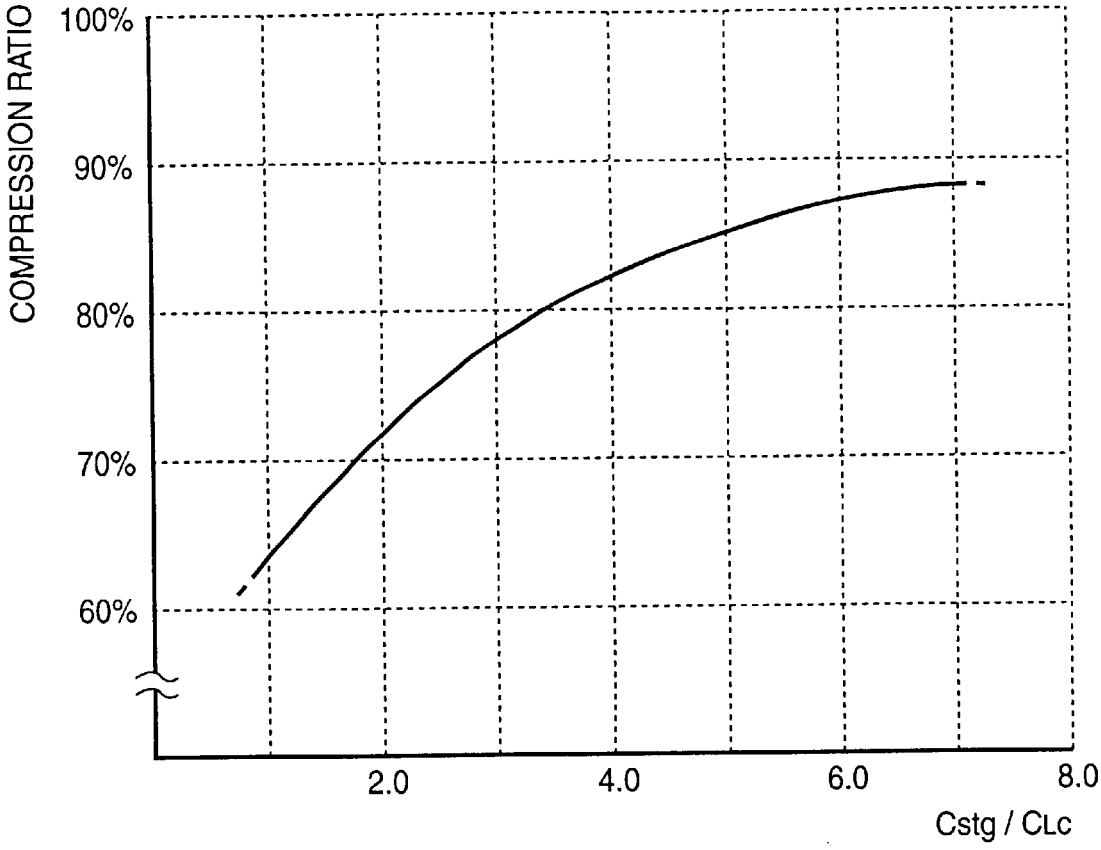
FIG. 15 shows the relationship between the ratio of storage capacitance to liquid crystal capacitance and the compression ratio of the output voltage in the liquid crystal display device.

Here, FIG. 15 is a diagram that simulates how the compression rate changes for the rate of storage capacitor $C_{stg}$ over (black display) liquid crystal capacitor $C_{Lc}$. For example, when the voltage shift of the other terminal of storage capacitor is 2.0 volts, if the voltage shift of the pixel electrode is 1.5 volts, the compression rate is 75%.

As shown in the figure, as the rate of storage capacitor $C_{stg}$ over the liquid crystal capacitor $C_{Lc}$ increases, the compression rate increases, but the rate will be saturated in the end. Especially, when the rate of storage capacitor $C_{stg}$ over the liquid crystal capacitor $C_{Lc}$ is about to exceed "4", the compression rate is saturated at 80% or more. Here, if the rate of storage capacitor $C_{stg}$ over the liquid crystal capacitor $C_{Lc}$ is about "4", the decrease amount of the swing voltage is at least 20% or less, thus it is realistic from the point of layout.

In order to compensate the decrease amount of the swing voltage, first, there is a method to increase the voltage amplitude of the initial writing voltage of the data signal supplied to the data line 114, however this can be contrary to the object of the present invention. Especially, if the voltage amplitude of the data signals S1, S2, . . . , Sn are greater than the swing voltage of logical level of the circuits from the shift register 150 to D/A converter 180, level shifters for enlarging the voltage amplitude at the output of D/A converter group 180, thereby making it difficult to reduce power consumption greatly. In other words, in the structure as shown in FIG. 2, it is necessary that the voltage amplitude of the data signals S1, S2, . . . , Sn are not greater than the voltage amplitude of logical level of the circuits from the shift register 150 to D/A converter 180.

In order to compensate the decrease amount of the swing voltage, second, there is a method to increase the voltage shift of the capacitor swing signal Yci. However, even if the voltage shift is enlarged too much, it is difficult to achieve the primary purpose of reducing power consumption.

Accordingly, simulations of the relationship between the voltage amplitude of the capacitor swing signal Yci (that is, voltage shift of the other terminal of the storage capacitor) and maximum-output voltage amplitude of the data signal D/A converted. The result of these simulations are each shown in FIGS. 16(*a*), 16(*b*), 16(*c*), 17(*a*), 17(*b*), and 17(*c*).

Figure 16:
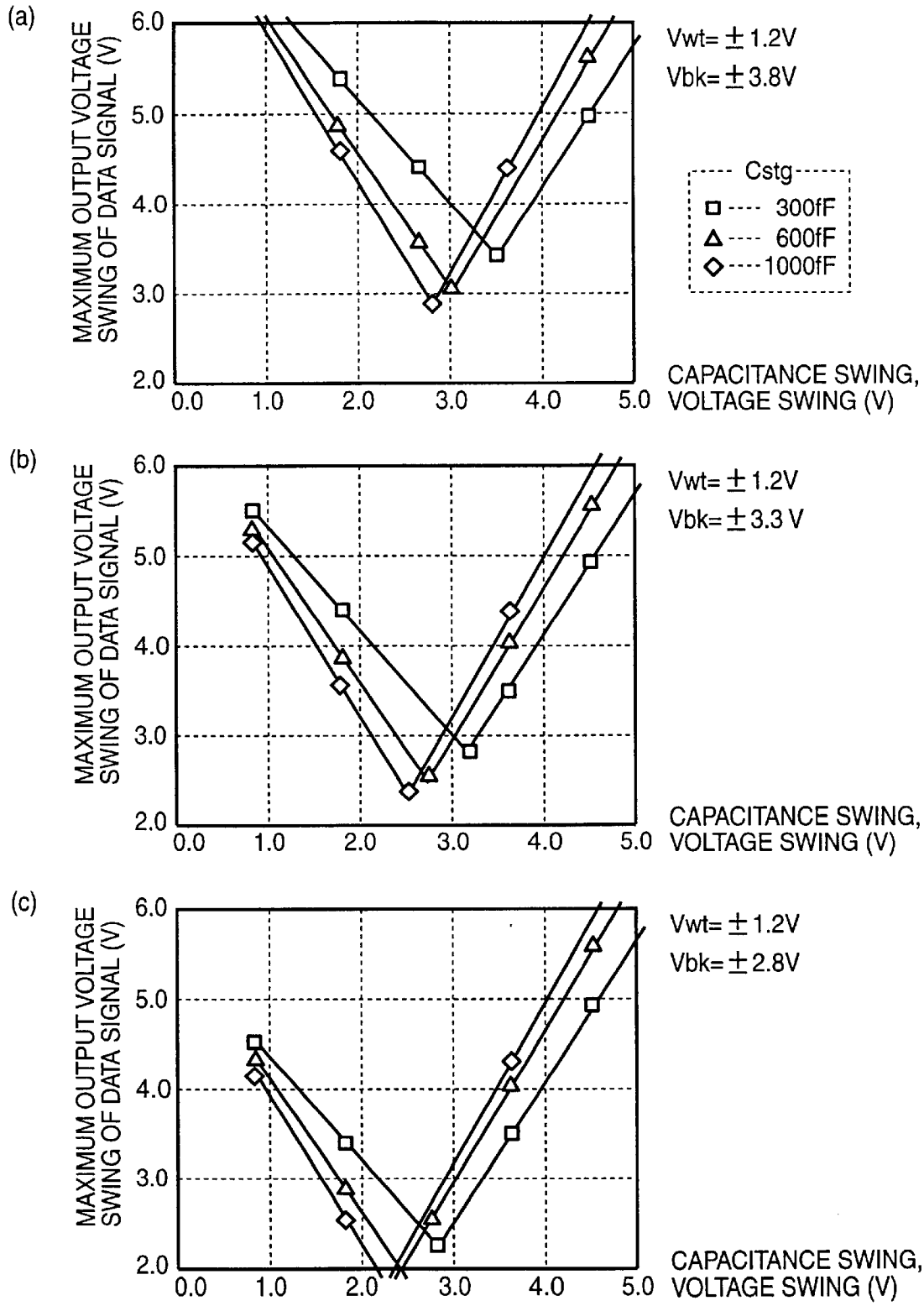
FIGS. 16(*a*), 16(*b*), and 16(*c*) each show the relationship between the amount of voltage shift at the other end of the storage capacitance and the maximum output swing voltage of the data line.

Among these figures, FIGS. 16(*a*), 16(*b*), and 16(*c*) are the figures when the finally applied voltage to the pixel electrode for the voltage of the counter electrode is, as for the white level, it is fixed as ±1.2 volts, and as for black level it is varied as ±2.8 volts, ±3.3 volts, and ±3.8 volts.

Figure 17:
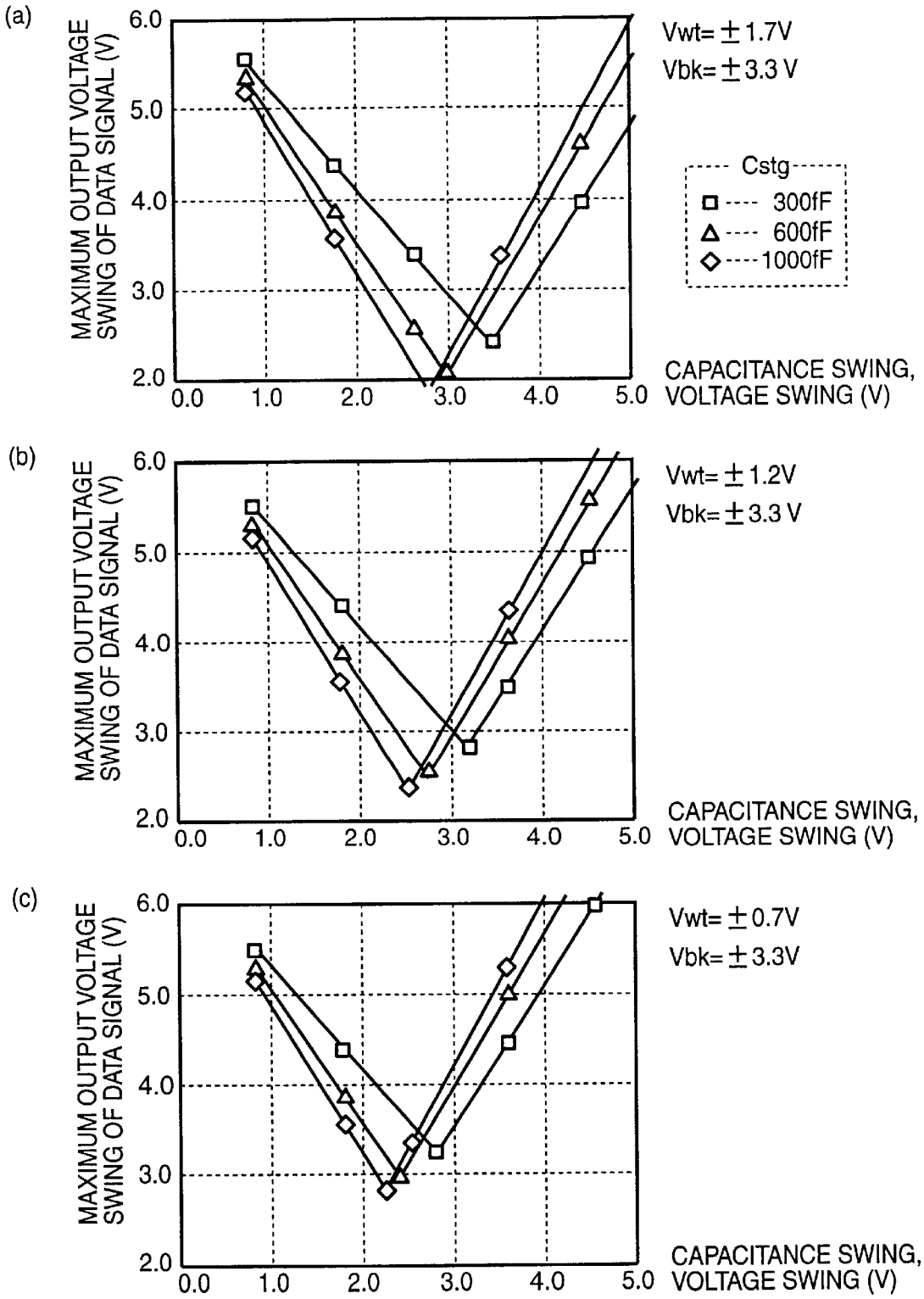
FIGS. 17(*a*), 17(*b*), and 17(*c*) each show the relationship between the amount of voltage shift at the other end of the storage capacitance and the maximum output swing voltage of the data line.

Also, among these figures, FIGS. 17(*a*), 17(*b*), and 17(*c*) are the figures when the finally applied voltage to the pixel electrode for the voltage of the counter electrode is, as for the black level, it is fixed as ±3.3 volts, and as for white level it is varied as ±0.7 volts, ±1.2 volts, and ±1.7 volts.

In this regard, in all the figures, the storage capacitor $C_{stg}$ is set as a parameter, and normally white mode is assumed to be employed. Also, the liquid crystal capacitor which is simulated is assumed to have a pixel electrode of 50 $\mu$m×150 $\mu$m, a distance between pixel electrode and counter electrode (cell gap) of 4.0 $\mu$m, a relative dielectric constant of 4.0 at white level and 12.0 at black level 12.0.

In all these simulation results, the maximum output voltage amplitude of the data signals have minimum values for the voltage amplitude of the capacitor swing signal Yci. Among these, in FIGS. 16(*a*), 16(*b*), and 16(*c*), as the voltage becomes larger for the black level, in a V-shaped characteristic, only the maximum output voltage amplitude of the left-side part increases, but the right-side part does not increase.

In FIGS. 17(*a*), 17(*b*), and 17(*c*), as the voltage becomes larger for the white level, in a V-shaped characteristic, only the maximum output voltage amplitude of the right-side part increases, but the left-side part does not increase.

Accordingly, from the above, the minimum value of the maximum output voltage amplitude of the data signal is determined by the voltage corresponding to white/black level and the storage capacitor $C_{stg}$.

For example, when combining the left-side part of the V-shaped characteristic in FIG. 16(*a*), and the right-side part of the V-shaped characteristic in FIG. 17(*c*), the maximum output voltage amplitude of the data signal can be kept 5.0 volts or less if the voltage amplitude of the capacitor swing signal Yci is in the range between 1.8 and 3.5 volts.

Particularly, when the storage capacitor $C_{stg}$ can be designed relatively freely, if the storage capacitor $C_{stg}$ is set to about 600 fF (femto farad), the maximum output voltage amplitude of the data signal may be kept 4.0 volts or less.

As a result, even if the maximum output voltage amplitude of the data signal is kept 5.0 volts or less under the conditions that the voltage amplitude of the logic levels of the circuits from the shift register 150 to D/A converter group 160 are 5.0 volts, in the present embodiment, it is possible to perform writing sufficiently to the liquid crystal capacitors.

In this regard, in the above-described embodiment, four-bit gray scale data, Data is used to perform 16 gray scale display, it should be understood that the present invention is not limited to this embodiment. For example, the number of bits can be increased to perform multiple gray levels, or one dot is composed of three pixels, R(red), G(green), and B(blue) to perform color display. Also, in the present embodiment, a description is given based on the normally white mode in which the maximum transmission factor appears when no voltage is applied to the liquid crystal capacitor, however it may be based on the normally black mode in which the minimum transmission factor appears when no voltage is applied to the liquid crystal capacitor.

Also, in the above-described embodiment, a description is given using an example of a row-inversion method in which polarity inversion is performed for every one horizontal scanning period, however, for example, a frame-inversion method may be used in which positive-polarity writing is performed for all the pixels on the odd number frames, whereas negative-polarity writing is performed for all the pixels on the even number frames.

Further, the arrangement can be made not using the line-sequence arrangement in which the data signals S1, S2, . . . , Sn are supplied all at once when the scanning signal Ysi for one row becomes H, but can be made using the point-sequence arrangement in which the data signals S1, S2, . . . , Sn are supplied in sequence when the scanning signal Ysi for one row becomes H, thus polarity inversion is performed for every column, thereby achieving column inversion. In addition, it is also possible to achieve pixel inversion in which column inversion and row inversion are combined to invert polarity for all adjacent pixels.

In the present embodiment, the arrangement is made in which, during one horizontal scanning period (1H), applying the preset voltage Vs (one of Vsw((+)), Vsk((+)), Vsw(−), and Vsk(−)) to the data line 114, and selecting the scanning line 112 and setting the corresponding scanning signal to H are exclusively performed. A reason for the arrangement is that when applying the preset voltage Vs to the data line 114, if one of the scanning lines 112 is selected, TFT116 which corresponds to the intersection of the selected scanning line and the data line turns on, thus capacitor load of the data line 114 increases, in which case needs to be avoided. Accordingly, if the capacitor load of the data line 114 is not a problem, the arrangement can be made in which the scanning signal is H even in the preset period in which the preset voltage Vs is applied.

Furthermore, in the present embodiment, a glass substrate is used for the element substrate 101, however, it should be understood that the element substrate 101 can be made by applying SOI (Silicon On Insulator) technology to form a silicon monocrystal film on an insulated substrate made of such as sapphire, quartz, and glass, and to create various elements there. Also, for the element substrate 101, a silicon substrate can be used, and various elements can be created there. When a silicon substrate is used in this way, for a switching element, high-speed field effect transistors can be used, thereby making it easy to achieve high-speed operations than TFT. However, when the element substrate 101 does not have transparency, it is necessary to use as a reflection type by forming the pixel electrode 118 using aluminum, or forming a separate reflection layer.

Also, in the present embodiment, as a switching element inserted between the data line 114 and the pixel electrode 118, a three-terminal element such as TFT is used, but a two-terminal element such as TFD (Thin Film Diode) can also be used.

Further, in the above-described embodiment, TN liquid crystal is used, but bistable liquid crystal having the memory capability such as BTN (Bi-stable Twisted Nematic) type and ferroelectric type, and polymer dispersed type, and the GH (guest-host) type liquid crystal in which dye molecules and crystal molecules are arranged in parallel by mixing the dye having anisotropy in absorption of visible light in the molecular longitudinal direction and latitudinal direction.

Also, the liquid crystal can be arranged in perpendicular alignment (homoetropic alignment) in which liquid crystal molecules are aligned perpendicularly to the substrates when no voltage is applied, whereas liquid crystal molecules are aligned horizontally to the substrates when voltage is applied, or it can be arranged in (horizontal) alignment (homogeneous alignment) in which liquid crystal molecules are aligned horizontally to the substrates when no voltage is applied, whereas liquid crystal molecules are aligned perpendicularly to the substrates when voltage is applied. In this way, in the present invention, various types of liquid crystal and alignment methods can be applied.

Next, some of the electronic apparatus to which the liquid crystal display device according to the above-described embodiment is applied will be described.

Figure 20:
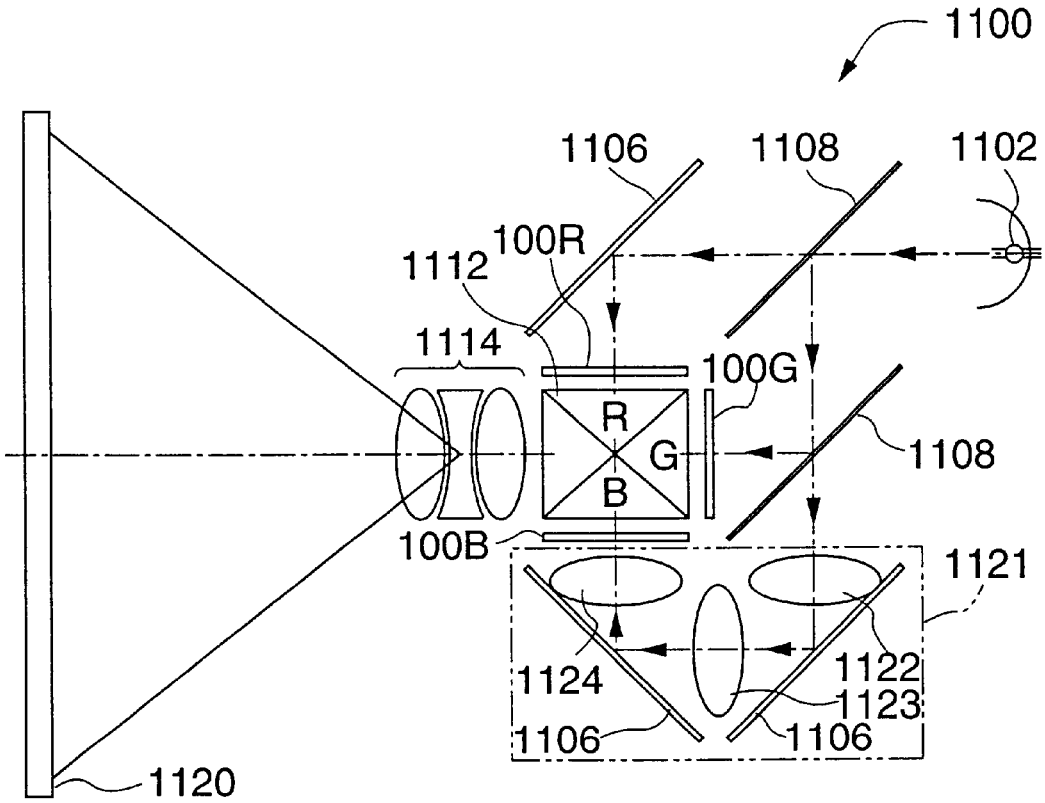
FIG. 20 is a sectional view showing the structure of a projector, which is an example of an electronic device to which the liquid crystal display device according to the present embodiment is applied.

First, a projector using the above-described liquid crystal display device 100 will be described. FIG. 20 is a plan view showing the structure of the projector.

As shown in the figure, within the projector 1100, a lamp unit 1102 is equipped with a white light source such as a halogen lamp. The projection light emitted from the lamp unit 1102 is separated into three primary colors of light, R (red), G (Green), and B (Blue), by three mirrors 1106 and two dichroic mirrors disposed inside the projector, and guided to light valves 100R, 100G, and 100B each of which corresponds to each primary color.

Here, the light valves 100R, 100G, and 100B are basically the same as the liquid crystal display device 100 according to the above-described embodiment. Specifically, the light valves 100R, 100G, and 100B work as light modulators for generating individual RGB primary color images, respectively.

Furthermore, since the B light has a longer light path compared with the other light, R and G, the light is guided through a relay lens system 1121 which consists of an incident lens 1122, a relay lens 1123, and an exit lens 1124 so as to prevent loss.

Now, each light modulated by one of the light valves 100R, 100G, and 100B enters into the dichroic prism 1112 from three directions. The R and B light is deflected 90 degrees via the dichroic prism 1112, while the G light goes straight through. As a result, a color image composed of each primary color image is projected onto a screen 1120 via a projection lens 1114.

In this regard, a dichroic mirror makes the light corresponding to each primary color RGB incident on the light valves 100R, 100G, and 100B, thereby making it unnecessary to arrange color filters as in the case of the direct viewing type.

Figure 21:
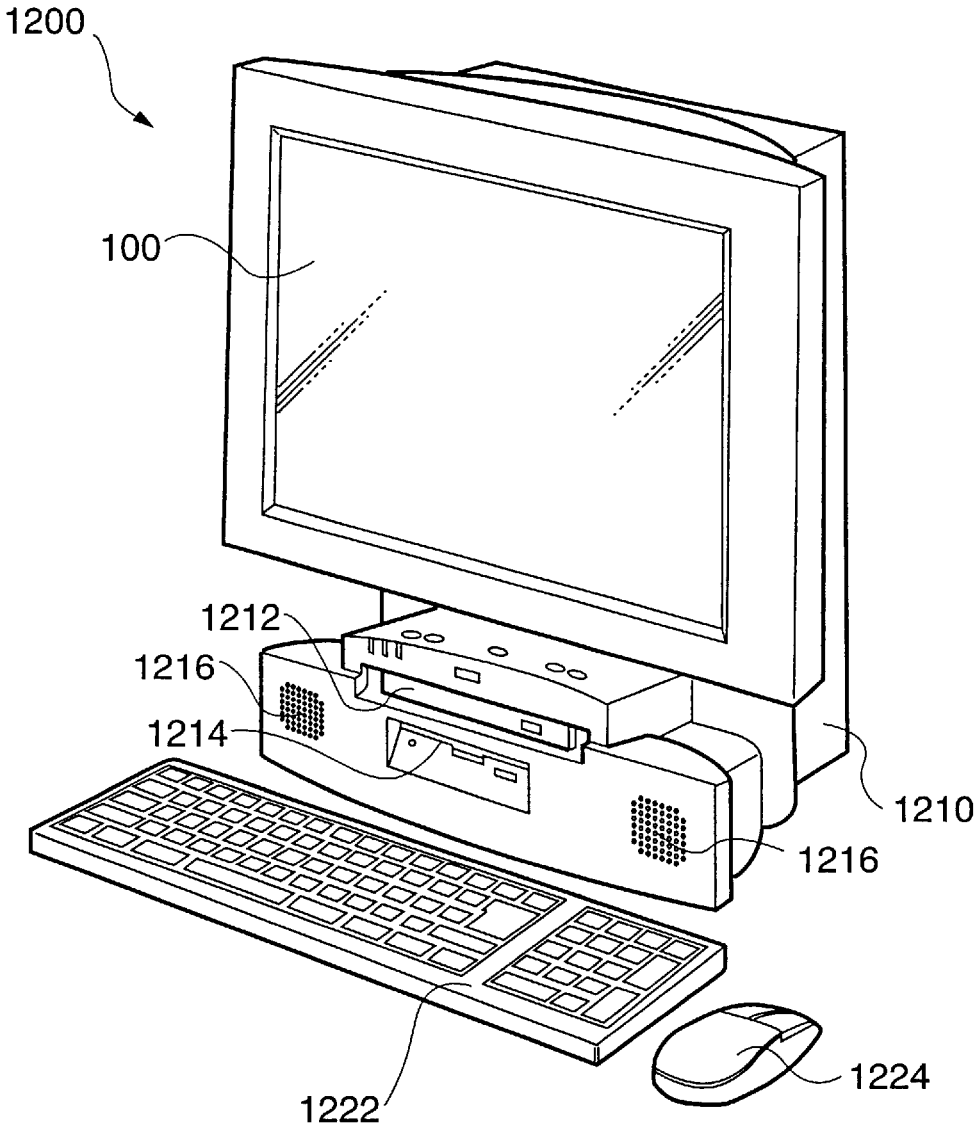
FIG. 21 is a perspective view showing the structure of a personal computer, which is an example of an electronic device to which the liquid crystal display device according to the present embodiment is applied.

Next, an example in which the above-described liquid crystal display device 100 is applied to a multimedia-enabled personal computer will be described. FIG. 21 is a perspective view showing the configuration of the personal computer.

As shown in the figure, a main unit 1210 of a computer 1200 is equipped with a liquid crystal display device 100 used as a display unit, an optical disk read/write drive 1212, a magnetic disk read/write drive 1214, and stereo speakers 1216. Also, the system is configured such that a keyboard 1222 and pointing device (mouse) 1224 send and receive input/control signals to and from the main unit 1210 by wireless such as via infrared rays.

This liquid crystal display device 100 is used as a direct viewing type, thus one dot is composed of three pixels, RGB, and a color filter is arranged corresponding to each pixel. Also, at the back of liquid crystal display device 100, a backlight unit (not shown in the figure) is provided in order to ensure visibility in dark places.

Figure 22:
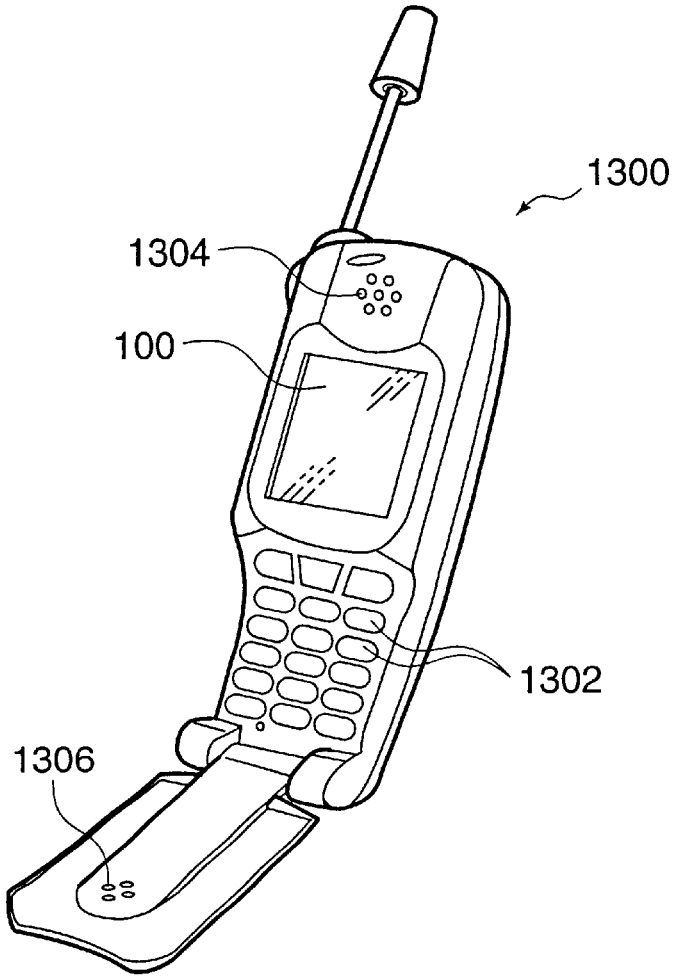
FIG. 22 is a perspective view showing the structure of a mobile phone, which is an example of an electronic device to which the liquid crystal display device according to the present embodiment is applied.

Furthermore, an example in which the above-described liquid crystal display device 100 is applied to a display unit of a mobile phone will be described. FIG. 22 is a perspective view showing the structure of the mobile phone. In the figure, a mobile phone 1300 includes a plurality of operator buttons 1302, a receiver 1304, a mouthpiece 1306, and the above-described liquid crystal display device 100. In this regard, on the back of the liquid crystal display device 100, a backlight unit (not shown) is arranged so as to ensure visibility in the dark, similarly to the above-described personal computer.

In this regard, as for the electronic apparatus, in addition to the devices described with reference to FIGS. 20, 21, and 22, there are flat-screen TVs, view finder-type/monitor-directly-view-type video tape recorders, car navigation systems, pagers, electronic diaries, calculators, word processors, workstations, TV telephones, POS terminals, digital still camera, devices with touch panels, and the like. The liquid crystal display device according to an embodiment, and its variations and changes can be applied to these various electronic devices without departing from the spirit and scope of the present invention.

As described above, the present invention can reduce the voltage amplitude of the voltage signal applied to a data line in comparison with the voltage amplitude applied to a pixel electrode, thus allowing power consumption to be reduced.

While this invention has been described in conjunction with the specific embodiments thereof, it is evident that many alternatives, modifications and variations will be apparent to those skilled in the art. Accordingly, preferred embodiments of the invention as set forth herein are intended to be illustrative not limiting. There are changes that may be made without departing from the spirit and scope of the invention.

What is claimed is:

1. A liquid crystal display device, comprising:

a scanning line to which an on-voltage is applied and then an off-voltage is applied;

a liquid crystal capacitor having a liquid crystal sandwiched between a counter electrode and a pixel electrode;

a D/A converter that applies a voltage, which corresponds to gray scale data indicating a gray level and to a writing polarity of a voltage applied to said liquid crystal, the voltage being applied to a data line when an on-voltage is applied to said scanning line;

a switching element disposed between said data line and said pixel electrode, said switching element being turned on when the on-voltage is applied to said scanning line, and being turned off when an off-voltage is applied; and a storage capacitor having first terminal connected to said pixel electrode and second terminal, wherein, when the writing polarity of a voltage applied to said liquid crystal during a period in which the on-voltage is applied to said scanning line is equivalent to that of positive-polarity writing, the voltage of second terminal is shifted to a high level when the off-voltage is applied to said scanning line, and when the writing polarity of a voltage applied to said liquid crystal during a period in which the on-voltage is applied to said scanning line is equivalent to that of negative-polarity writing, the voltage of the second terminal is shifted to a low level when the off-voltage is applied to said scanning line the voltage applied to the second terminal when the on-voltage is applied to the scanning line being different from the voltage applied to the second terminal when the off-voltage is applied to the scanning line.

2. A liquid crystal display device according to claim 1, the other terminal of said storage capacitor being connected to each row in common via a capacitor line.

3. An electronic apparatus comprising a liquid crystal display device according to claim 1.

4. A liquid crystal display device, comprising:

a scanning line to which an on-voltage is applied and then an off-voltage is applied;

a liquid crystal capacitor having a liquid crystal sandwiched between a counter electrode and a pixel electrode;

a D/A converter that applies a voltage, which corresponds to gray scale data indicating a gray level and to a writing polarity of a voltage applied to said liquid crystal, the voltage being applied to a data line when an on-voltage is applied to said scanning line;

a switching element disposed between said data line and said pixel electrode, said switching element being turned on when the on-voltage is applied to said scanning line, and being turned off when an off-voltage is applied; and a storage capacitor having one terminal connected to said pixel electrode, wherein, when the writing polarity of a voltage applied to said liquid crystal during a period in which the on-voltage is applied to said scanning line is equivalent to that of positive-polarity writing, the voltage of another terminal is shifted to a high level when the off-voltage is applied to said scanning line, and when the writing polarity of a voltage applied to said liquid crystal during a period in which the on-voltage is applied to said scanning line is equivalent to that of negative-polarity writing, the voltage of the other terminal is shifted to a low level when the off-voltage is applied to said scanning line, wherein in the case where said writing polarity of a voltage applied to said liquid crystal is one of positive-polarity and negative-polarity, the display device further comprises:

a first power feeding line which is fed with a first voltage during a preset period, and which is fed with a second voltage which is higher than said first voltage during a set period after said preset period;

a second power feeding line which is fed with a third voltage which is higher than said second voltage during said preset period, and which is fed with a fourth voltage which is lower than said third voltage and higher than said second voltage during said set period after said preset period; and a selector that selects one of said first and second power feeding lines during said preset period, and that selects the other one of said first and second power feeding lines during said set period, wherein said D/A converter generates a supply voltage to said data line using the corresponding voltage selected by said selector during said preset period and said set period.

5. A liquid crystal display device according to claim 4, wherein in the case where said writing polarity of a voltage applied to said liquid crystal is the other one of positive-polarity and negative-polarity, the first power feeding line is fed with a fifth voltage during the preset period, and is fed with a sixth voltage which is higher than said fifth voltage during the set period after said preset period, whereas the second power feeding line is fed with a seventh voltage which is higher than said sixth voltage during said preset period, and is fed with an eighth voltage which is lower than said seventh voltage and higher than said sixth voltage during said set period.

6. A liquid crystal display device, comprising:

a scanning line to which an on-voltage is applied and then an off-voltage is applied;

a liquid crystal capacitor having a liquid crystal sandwiched between a counter electrode and a pixel electrode;

a D/A converter that applies a voltage, which corresponds to gray scale date indicating a gray level and to a writing polarity of a voltage applied to said liquid crystal, the voltage being applied to a data line when an on-voltage is applied to said scanning line;

a switching element disposed between said data line and said pixel electrode, said switching element being turned on when the on-voltage is applied to said scanning line, and being turned off when an off-voltage is applied; and a storage capacitor having one terminal connected to said pixel electrode, wherein, when the writing polarity of a voltage applied to said liquid crystal during a period in which the on-voltage is applied to said scanning line is equivalent to that of positive-polarity writing, the voltage of another terminal is shifted to a high level when the off-voltage is applied to said scanning line, and when the writing polarity of a voltage applied to said liquid crystal during a period in which the on-voltage is applied to said scanning line is equivalent to that of negative-polarity writing, the voltage of the other terminal is shifted to a low level when the off-voltage is applied to said scanning line, wherein said D/A converter includes, in the case where said writing polarity of a voltage applied to said liquid crystal is one of positive-polarity and negative-polarity;

a first switch that applies one of a first or third voltage to said data line corresponding to upper bits of said gray scale data during a preset period; and a capacitor having a capacitance corresponding to the lower bits excluding the upper bits from said gray scale data, wherein, in the case where said first voltage is applied to said data line, a fourth voltage which is higher than said first voltage is applied to one terminal, whereas, in the case where said third voltage is applied to said data line, a second voltage which is higher than said third voltage is applied to one terminal, and another terminal is connected to said data line during a set period after said preset period.

7. A liquid crystal display device according to claim 6, capacitor further comprising a bit capacitor corresponding to weighting of said lower bits, and a second switch which is arranged corresponding to said bit capacitor, and which is turned on or off depending on said lower bits.

8. A liquid crystal display device according to claim 6, further comprising:

a first power feeding line which is fed with said first voltage during said preset period, and which is fed with said second voltage during said set period after the preset period;

a second power feeding line which is fed with said third voltage during said preset period, and which is fed with said fourth voltage during said set period; and a selector which selects either one of said first power feeding line or said second power feeding line based on said upper bits, and that supplies the voltage which is fed to the selected power feeding line to the input terminal of said first switch during said preset period, and which selects the other one of said first power feeding line or said second power feeding line during said preset period, and feeds the voltage which is fed to the selected power feeding line to one terminal of said capacitor.

9. A liquid crystal display device according to claim 6, wherein, in the case where said writing polarity of a voltage applied to said liquid crystal is the other one of positive-polarity and negative-polarity;

said first switch supplies one of a fifth voltage or a seventh voltage to said data line based on the upper bits of said gray scale data during the preset period, and one terminal of said capacitor is supplied with an eighth voltage which is higher than said fifth voltage in the case where said data line is supplied with said fifth voltage, whereas seventh voltage in the case where said data line is supplied with said seventh voltage.

10. A liquid crystal display device according to claim 9, wherein a first power feeding line is fed with a fifth voltage during the preset period, and is fed with a sixth voltage during said set period after the preset period, whereas a second power feeding line is fed with the seventh voltage during said preset period, and being fed with the eighth voltage during said set period.

11. A liquid crystal display device, comprising:

a scanning line to which an on-voltage is applied and then an off-voltage is applied;

a liquid crystal capacitor having a liquid crystal sandwiched between a counter electrode and a pixel electrode;

a D/A converter that applies a voltage, which corresponds to gray scale data indicating a gray level and to a writing polarity of a voltage applied to said liquid crystal, the voltage being applied to a data line when an on-voltage is applied to said scanning line;

a switching element disposed between said data line and said pixel electrode, said switching element being turned on when the on-voltage is applied to said scanning line, and being turned off when an off-voltage is applied; and a storage capacitor having one terminal connected to said pixel electrode, wherein, when the writing polarity of a voltage applied to said liquid crystal during a period in which the on-voltage is applied to said scanning line is equivalent to that of positive-polarity writing, the voltage of another terminal is shifted to a high level when the off-voltage is applied to said scanning line, and when the writing polarity of a voltage applied to said liquid crystal during a period in which the on-voltage is applied to said scanning line is equivalent to that of negative-polarity writing, the voltage of the other terminal is shifted to a low level when the off-voltage is applied to said scanning line, the ration of the capacitance of said storage capacitor to said liquid crystal capacitor being four or greater.

12. A driving circuit for a liquid crystal display device, including a liquid crystal capacitor arranged at a intersection of a scanning line and a data line, and having a liquid crystal sandwiched between a counter electrode and pixel electrode, a switching element inserted between said data line and said pixel electrode, said switching element being turned on when an on-voltage is applied to said scanning line, and being turned off when an off-voltage is applied to said scanning line, and a capacitor having first terminal connected to said pixel electrode and second terminal, the driving circuit comprising:

a scanning line driving circuit that applies said on-voltage to said scanning line, and then applies said off-voltage to said scanning line;

a D/A converter that applies a voltage corresponding to gray scale data indicating a gray level, and corresponding to a writing polarity of a voltage applied to said liquid crystal, to a data line when said scanning line driving circuit applies the on-voltage to said scanning line; and a storage capacitor driving circuit wherein, when, in the case of applying the on- voltage to said scanning line, the voltage applied to said data line is equivalent to that of positive-polarity writing, then the voltage of the second terminal is shifted to high when the off-voltage is applied to said scanning line, and when in the case of applying the on-negative-polarity writing when the off-voltage is applied to said scanning line, then the voltage of the second terminal of said storage capacitor is shifted to low, the voltage applied to the second terminal when the on-voltage is applied to the scanning line being different from the voltage applied to the second terminal when the off-voltage is applied to the scanning line.

13. A driving method for a liquid crystal display device having a liquid crystal capacitor disposed at the intersection of a scanning line and a data line, and further having a liquid crystal sandwiched between a counter electrode and a pixel electrode, a switching element inserted between said data line and said pixel electrode, said switching element being turned on when an on-voltage is applied to said scanning line, and being turned off when an off-voltage is applied to said scanning line, and a storage capacitor having first terminal connected to said pixel electrode and second terminal, the driving method comprising:

applying an on-voltage to said scanning line;

applying a voltage corresponding to gray scale data indicating a gray level, and corresponding to a writing polarity of a voltage applied to said liquid crystal, to a data line;

applying off-voltage to said scanning line; if the writing polarity of a voltage applied to said liquid crystal to said data line is equivalent to that of positive-polarity writing, shifting the voltage of second terminal to high; and if the writing polarity of a voltage applied to said liquid crystal to said scanning line is equivalent to that of negative-polarity writing, shifting the voltage of the second terminal of said storage capacitor to low when the off-voltage is applied to said scanning line, the voltage applied to the second terminal when the on-voltage is applied to the scanning line being different from the voltage applied to the second terminal when the off-voltage is applied to the scanning line.

* * * * *